US010662828B1

(12) United States Patent
Fischer et al.

(10) Patent No.: US 10,662,828 B1
(45) Date of Patent: May 26, 2020

(54) CAMSHAFT PHASER

(71) Applicant: DELPHI TECHNOLOGIES IP LIMITED, St. Michael (BB)

(72) Inventors: Thomas H. Fischer, Rochester, NY (US); Prashant Bhokardole, Bangalore (IN)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 16/216,561

(22) Filed: Dec. 11, 2018

(51) Int. Cl.
*F01L 1/344* (2006.01)

(52) U.S. Cl.
CPC ..... *F01L 1/3442* (2013.01); *F01L 1/34409* (2013.01); *F01L 2001/3443* (2013.01); *F01L 2001/34469* (2013.01)

(58) Field of Classification Search
CPC ..... F01L 2001/34426; F01L 2001/3443; F01L 2001/34433; F01L 2001/34436; F01L 2001/34479; F01L 1/46
USPC ..... 123/90.15, 90.17
See application file for complete search history.

(56) References Cited

U.S. PATENT DOCUMENTS

| | | | | |
|---|---|---|---|---|
| 6,772,721 | B1 | 8/2004 | Gardner et al. | |
| 7,000,580 | B1 | 2/2006 | Smith et al. | |
| 7,137,371 | B2 | 11/2006 | Simpson et al. | |
| 8,534,246 | B2 | 9/2013 | Lichti et al. | |
| 9,587,526 | B2 | 3/2017 | Lichti | |
| 9,958,076 | B2 * | 5/2018 | Kobayashi | F16K 11/07 |
| 10,082,054 | B2 | 9/2018 | Haltiner, Jr. et al. | |
| 2013/0206088 | A1 | 8/2013 | Wigsten | |
| 2015/0369092 | A1 * | 12/2015 | Parker | F01L 9/025 123/90.12 |
| 2016/0024978 | A1 * | 1/2016 | Lichti | F01L 1/34409 123/90.15 |
| 2016/0201822 | A1 * | 7/2016 | Takada | F01L 1/3442 251/129.15 |
| 2017/0130618 | A1 * | 5/2017 | Haltiner, Jr. | F01L 1/047 |
| 2017/0198611 | A1 | 7/2017 | Hamasaki et al. | |
| 2017/0198612 | A1 * | 7/2017 | Noguchi | F01L 1/047 |
| 2018/0156079 | A1 * | 6/2018 | Yamakawa | F01L 1/3442 |
| 2018/0245488 | A1 * | 8/2018 | Hamasaki | F15B 13/0402 |
| 2018/0355766 | A1 * | 12/2018 | Leblay | F01L 1/3442 |
| 2019/0085736 | A1 * | 3/2019 | Stanhope | F01L 1/3442 |

* cited by examiner

*Primary Examiner* — Jorge L Leon, Jr.
(74) *Attorney, Agent, or Firm* — Joshua M. Haines

(57) ABSTRACT

A camshaft phaser includes an input member connectable to the crankshaft of an engine; an output member connectable to a camshaft of the engine and defining an advance chamber and a retard chamber with the input member. A valve spool is moveable between an advance position and a retard position and includes a valve spool bore extending thereinto. An insert within the valve spool bore and carries a check valve. The check valve includes a check valve member which moves between a seated position and an unseated position. The check valve also includes a check valve positioning member which is held in compression against an inner periphery of the valve spool bore such that compression of the check valve positioning member holds the check valve in contact with the insert.

16 Claims, 20 Drawing Sheets

12

CAMSHAFT PHASER

TECHNICAL FIELD OF INVENTION

The present invention relates to a camshaft phaser for varying the phase relationship between a crankshaft and a camshaft in an internal combustion engine; more particularly to such a camshaft phaser which includes a valve for changing position of the camshaft phaser.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers by a phasing oil control valve in order to rotate the rotor within the stator and thereby change the phase relationship between the camshaft and the crankshaft. One such camshaft phaser is described in U.S. Pat. No. 8,534,246 to Lichti et al., the disclosure of which is incorporated herein by reference in its entirety and hereinafter referred to as Lichti et al. '246.

While the camshaft phaser of Lichti et al. '246 may be effective, the camshaft phaser may be parasitic on the lubrication system of the internal combustion engine which also supplies the oil for rotating the rotor relative to the stator, thereby requiring increased capacity of an oil pump of the internal combustion engine which adds load to the internal combustion engine. In an effort to reduce the parasitic nature of camshaft phasers, so-called cam torque actuated camshaft phasers have also been developed. In a cam torque actuated camshaft phaser, oil is moved directly from the advance chambers to the retard chambers or directly from the retard chambers to the advance chambers based on torque reversals imparted on the camshaft from intake and exhaust valves of the internal combustion engine. The torque reversals are predictable and cyclical in nature and alternate from tending to urge the rotor in the advance direction to tending to urge the rotor in the retard direction. The effects of the torque reversals on oil flow are known to be controlled by a valve spool positioned by a solenoid actuator. Accordingly, in order to advance the camshaft phaser, the valve spool is positioned by the solenoid actuator to create a passage with a first check valve therein which allows torque reversals to transfer oil from the advance chambers to the retard chambers while preventing torque reversals from transferring oil from the retard chambers to the advance chambers. Conversely, in order to retard the camshaft phaser, the valve spool is positioned by the solenoid actuator to create a passage with a second check valve therein which allows torque reversals to transfer oil from the retard chambers to the advance chambers while preventing torque reversals from transferring oil from the advance chambers to the retard chambers. However, requiring two check valves adds cost and complexity to the system. One such camshaft phaser is described in U.S. Pat. No. 7,000,580 to Smith et al., hereinafter referred to as Smith et al.

Another such cam torque actuated camshaft phaser is described in U.S. Pat. No. 7,137,371 to Simpson et al., hereinafter referred to as Simpson et al. Simpson et al. differs from Smith et al. in that Simpson et al. requires only one check valve to transfer oil from the advance chambers to the retard chambers and to transfer oil from the retard chambers to the advance chambers. While Simpson et al. eliminates one check valve compared to Smith et al., the passages of Simpson et al. that are required to implement the single check valve add further complexity because the check valve is located remotely from the valve spool.

Yet another such cam torque actuated camshaft phaser is described in United States Patent Application Publication No. US 2013/0206088 A1 to Wigsten, hereinafter referred to as Wigsten. Wigsten differs from Simpson et al. in that the check valve that is used to transfer oil from the advance chambers to the retard chambers and to transfer oil from the retard chambers to the advance chambers is located within the valve spool. However, placement of the check valve within the valve spool as implemented by Wigsten complicates the manufacture of the valve spool and adds further complexity to passages needed in the valve body within which the valve spool is slidably disposed.

Still yet another cam torque actuated camshaft phaser is described in U.S. Pat. No. 9,587,526 to Lichti et al., the disclosure of which is incorporated herein by reference in its entirety and hereinafter referred to as Lichti et al. '526. Lichti et al. '526 simplifies implementation of the of the check valve that is used to control phasing, however, the check valves of Lichti et al. may not be adequately constrained which may lead to wear over time due to the high number of opening and closing events which occur in the expected life-time use of the camshaft phaser which extends into the billions of cycles.

What is needed is camshaft phaser which minimizes or eliminates one or more the shortcomings as set forth above.

SUMMARY OF THE INVENTION

Briefly described, a camshaft phaser is provided for use with an internal combustion engine for controllably varying the phase relationship between a crankshaft and a camshaft in the internal combustion engine. The camshaft phaser includes an input member connectable to the crankshaft of the internal combustion engine to provide a fixed ratio of rotation between the input member and the crankshaft; an output member connectable to the camshaft of the internal combustion engine and defining an advance chamber and a retard chamber with the input member; a valve spool moveable along an axis between an advance position and a retard position and having a valve spool bore extending thereinto along the axis, wherein the advance position allows oil to be vented from the advance chamber and to be supplied to the retard chamber from the valve spool bore in order to advance the timing of the camshaft relative to the crankshaft and wherein the retard position allows oil to be vented from the retard chamber and to be supplied to the advance chamber from the valve spool bore in order to retard the timing of the camshaft relative to the crankshaft; an insert within the valve spool bore; and a check valve carried by the insert within the valve spool bore, the check valve including a check valve member which moves between a seated position and an unseated position such that the check valve member prevents fluid flow out of the valve spool bore through a passage and such that the check valve member permits flow into the valve spool bore through the passage, and the check valve also including a check valve positioning member which is held in compression against an inner periphery of the valve spool bore such that compression of the check valve positioning member holds the check valve in contact with the insert when the check valve member is in the seated position and also when the check valve member is in the unseated position. The camshaft phaser including the valve spool, the insert, and the check valve as described herein allows for simplified construction of the camshaft phaser compared to the prior art and ensures that the check valve is supported by the insert while minimizing sliding contact between the check valve and the insert, thereby minimizing wear.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
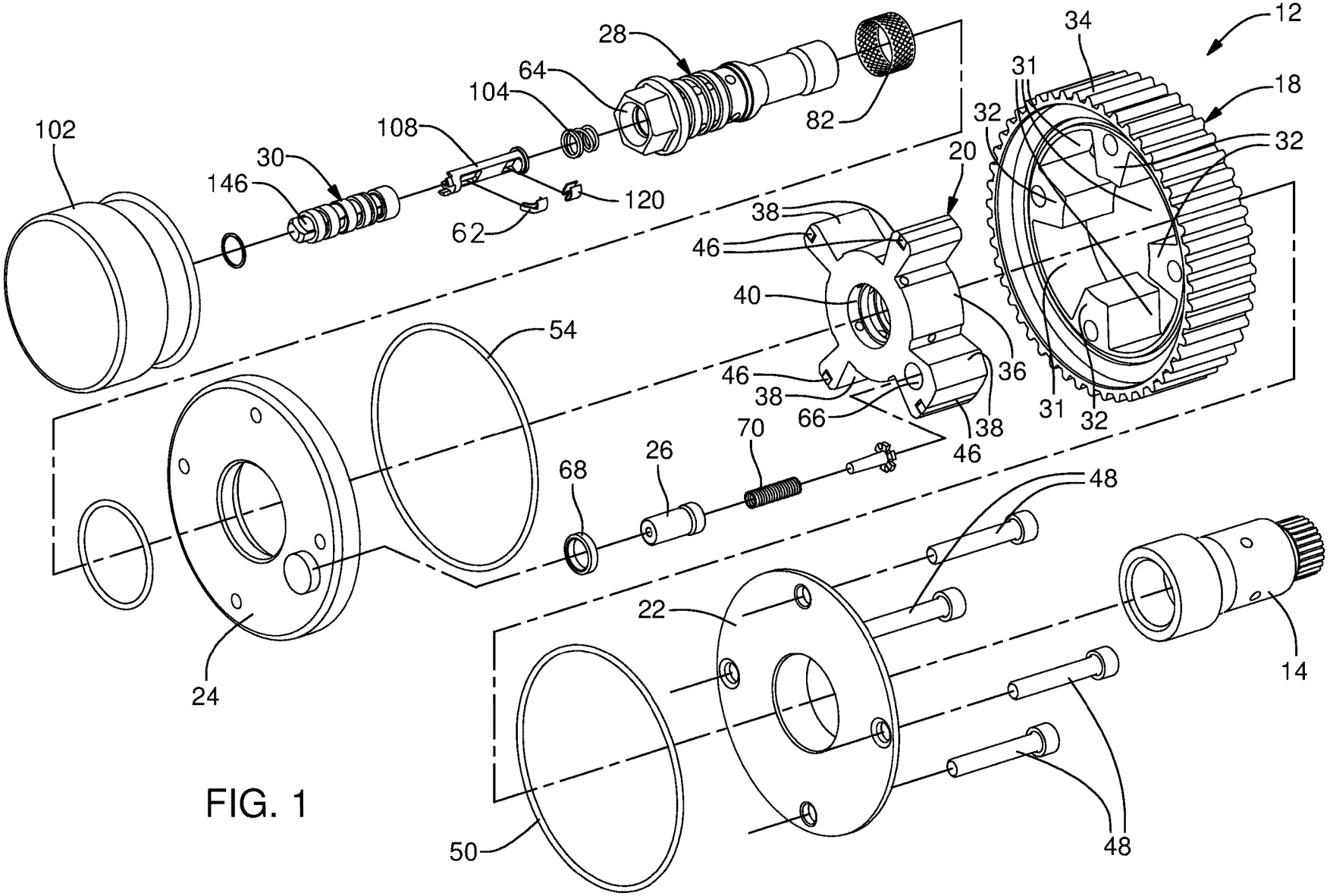
FIG. 1 is an exploded isometric view of a camshaft phaser.

Referring initially to FIGS. 1-4, an internal combustion engine 10 is shown which includes a camshaft phaser 12. Internal combustion engine 10 also includes a camshaft 14 which is rotatable about a camshaft axis 16 based on rotational input from a crankshaft and belt (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 18 which acts and an input member, a rotor 20 disposed coaxially within stator 18 which acts as an output member, a back cover 22 closing off one end of stator 18, a front cover 24 closing off the other end of stator 18, a lock pin 26, a camshaft phaser attachment bolt 28 for attaching camshaft phaser 12 to camshaft 14, and a valve spool 30. The various elements of camshaft phaser 12 will be described in greater detail in the paragraphs that follow.

Stator 18 is generally cylindrical and includes a plurality of radial chambers 31 defined by a plurality of lobes 32 extending radially inward. In the embodiment shown, there are four lobes 32 defining four radial chambers 31, however, it is to be understood that a different number of lobes 32 may be provided to define radial chambers 31 equal in quantity to the number of lobes 32. Stator 18 may also include a toothed pulley 34 formed integrally therewith or otherwise fixed thereto. Pulley 34 is configured to be driven by a belt that is driven by the crankshaft of internal combustion engine 10. Alternatively, pulley 34 may be a sprocket driven by a chain or other any other known drive member known for driving camshaft phaser 12 by the crankshaft.

Rotor 20 includes a central hub 36 with a plurality of vanes 38 extending radially outward therefrom and a rotor central through bore 40 extending axially therethrough. The number of vanes 38 is equal to the number of radial chambers 31 provided in stator 18. Rotor 20 is coaxially disposed within stator 18 such that each vane 38 divides each radial chamber 31 into advance chambers 42 and retard chambers 44. The radial tips of lobes 32 are mateable with central hub 36 in order to separate radial chambers 31 from each other. Each of the radial tips of vanes 38 may include one of a plurality of wiper seals 46 to substantially seal adjacent advance chambers 42 and retard chambers 44 from each other. While not shown, each of the radial tips of lobes 32 may also include one of a plurality of wiper seals 46.

Back cover 22 is sealingly secured, using cover bolts 48, to the axial end of stator 18 that is proximal to camshaft 14. Tightening of cover bolts 48 prevents relative rotation between back cover 22 and stator 18. A back cover seal 50, for example only, an O-ring, may be provided between back cover 22 and stator 18 in order to provide an oil-tight seal between the interface of back cover 22 and stator 18. Back cover 22 includes a back cover central bore 52 extending coaxially therethrough. The end of camshaft 14 is received coaxially within back cover central bore 52 such that camshaft 14 is allowed to rotate relative to back cover 22. In an alternative arrangement, pulley 34 may be integrally formed or otherwise attached to back cover 22 rather than stator 18.

Similarly, front cover 24 is sealingly secured, using cover bolts 48, to the axial end of stator 18 that is opposite back cover 22. A front cover seal 54, for example only, an O-ring, may be provided between front cover 24 and stator 18 in order to provide an oil-tight seal between the interface of front cover 24 and stator 18. Cover bolts 48 pass through back cover 22 and stator 18 and threadably engage front cover 24, thereby clamping stator 18 between back cover 22 and front cover 24 to prevent relative rotation between stator 18, back cover 22, and front cover 24. In this way, advance chambers 42 and retard chambers 44 are defined axially between back cover 22 and front cover 24.

Camshaft phaser 12 is attached to camshaft 14 with camshaft phaser attachment bolt 28 which extends coaxially through rotor central through bore 40 of rotor 20 and threadably engages camshaft 14, thereby by clamping rotor 20 securely to camshaft 14. In this way, relative rotation between stator 18 and rotor 20 results in a change is phase or timing between the crankshaft of internal combustion engine 10 and camshaft 14.

Oil is selectively transferred to advance chambers 42 from retard chambers 44, as result of torque applied to camshaft 14 from the valve train of internal combustion engine 10, i.e. torque reversals of camshaft 14, in order to cause relative rotation between stator 18 and rotor 20 which results in retarding the timing of camshaft 14 relative to the crankshaft of internal combustion engine 10. Conversely, oil is selectively transferred to retard chambers 44 from advance chambers 42, as result of torque applied to camshaft 14 from the valve train of internal combustion engine 10, in order to cause relative rotation between stator 18 and rotor 20 which results in advancing the timing of camshaft 14 relative to the crankshaft of internal combustion engine 10. Rotor advance passages 56 may be provided in rotor 20 for supplying and venting oil to and from advance chambers 42 while rotor retard passages 58 may be provided in rotor 20 for supplying and venting oil to and from retard chambers 44. Transferring oil to advance chambers 42 from retard chambers 44 and transferring oil to retard chambers 44 from advance chambers 42 is controlled by valve spool 30 and a phasing check valve 62, as will be described in detail later, such that valve spool 30 is coaxially disposed slidably within a valve bore 64 of camshaft phaser attachment bolt 28 where valve bore 64 is centered about camshaft axis 16.

Lock pin 26 selectively prevents relative rotation between stator 18 and rotor 20 at a predetermined aligned position of rotor 20 within stator 18, which as shown, may be a full advance position, i.e. rotor 20 as far as possible within stator 18 in the advance direction of rotation. Lock pin 26 is slidably disposed within a lock pin bore 66 formed in one vane 38 of rotor 20. A lock pin seat 68 is provided in front cover 24 for selectively receiving lock pin 26 therewithin. Lock pin 26 and lock pin seat 68 are sized to substantially prevent rotation between stator 18 and rotor 20 when lock pin 26 is received within lock pin seat 68. When lock pin 26 is not desired to be seated within lock pin seat 68, pressurized oil is supplied to lock pin bore 66 through a rotor lock pin passage 72 formed in rotor 20, thereby urging lock pin 26 out of lock pin seat 68 and compressing a lock pin spring 70. Conversely, when lock pin 26 is desired to be seated within lock pin seat 68, the pressurized oil is vented from lock pin bore 66 through rotor lock pin passage 72, thereby allowing lock pin spring 70 to urge lock pin 26 toward front cover 24. In this way, lock pin 26 is seated within lock pin seat 68 by lock pin spring 70 when rotor 20 is positioned within stator 18 to allow alignment of lock pin 26 with lock pin seat 68. Supplying and venting of pressurized oil to and from lock pin 26 is controlled by valve spool 30 as will be described later.

Camshaft phaser attachment bolt 28 and valve spool 30, which act together to function as a valve, will now be described in greater detail with continued reference to FIGS. 1-4 and now with additional reference to FIGS. 5A-11. Camshaft phaser attachment bolt 28 includes bolt supply passages 74 which extend radially outward from valve bore 64 to the outside surface of camshaft phaser attachment bolt 28. Bolt supply passages 74 receive pressurized oil from an oil source 76, for example, an oil pump of internal combustion engine 10, via an annular oil supply passage 78 formed radially between camshaft phaser attachment bolt 28 and a counter bore of camshaft 14 and also via radial camshaft oil passages 80 of camshaft 14. The pressurized oil from oil source 76 is used to 1) replenish oil that may leak from advance chambers 42 and retard chambers 44 in use, 2) to disengage lock pin 26 from lock pin seat 68, and 3) to replenish oil that is vented from lock pin 26. A filter 82 may circumferentially surround camshaft phaser attachment bolt 28 at bolt supply passages 74 in order to prevent foreign matter that may be present in the oil from reaching valve spool 30.

Camshaft phaser attachment bolt 28 also includes a bolt annular lock pin groove 84 on the outer periphery of camshaft phaser attachment bolt 28 and bolt lock pin passages 86 extend radially outward from valve bore 64 to bolt annular lock pin groove 84. Bolt annular lock pin groove 84 is spaced axially apart from bolt supply passages 74 in a direction away from camshaft 14 and is aligned with a rotor annular lock pin groove 88 which extends radially outward from rotor central through bore 40 such that rotor lock pin passage 72 extends from rotor annular lock pin groove 88 to lock pin bore 66. In this way, fluid communication is provided between valve bore 64 and lock pin bore 66.

Camshaft phaser attachment bolt 28 also includes a bolt annular advance groove 90 on the outer periphery of camshaft phaser attachment bolt 28 and bolt advance passages 92 extend radially outward from valve bore 64 to bolt annular advance groove 90. Bolt annular advance groove 90 is spaced axially apart from bolt supply passages 74 and bolt annular lock pin groove 84 such that bolt annular lock pin groove 84 is axially between bolt supply passages 74 and bolt annular advance groove 90. Bolt annular advance groove 90 is aligned with a rotor annular advance groove 94 which extends radially outward from rotor central through bore 40 such that rotor advance passages 56 extend from rotor annular advance groove 94 to advance chambers 42. In this way, fluid communication is provided between valve bore 64 and advance chambers 42.

Camshaft phaser attachment bolt 28 also includes a bolt annular retard groove 96 on the outer periphery of camshaft phaser attachment bolt 28 and bolt retard passages 98 extend radially outward from valve bore 64 to bolt annular retard groove 96. Bolt annular retard groove 96 is spaced axially apart from bolt annular advance groove 90 such that bolt annular advance groove 90 is axially between bolt annular lock pin groove 84 and bolt annular retard groove 96. Bolt annular retard groove 96 and is aligned with a rotor annular retard groove 100 which extends radially outward from rotor central through bore 40 such that rotor retard passages 58 extend from rotor annular retard groove 100 to retard chambers 44. In this way, fluid communication is provided between valve bore 64 and retard chambers 44.

Valve spool 30 is moved axially within valve bore 64 of camshaft phaser attachment bolt 28 by an actuator 102 and a valve spring 104 to achieve desired operational states of camshaft phaser 12 by opening and closing bolt supply passages 74, bolt lock pin passages 86, bolt advance passages 92, and bolt retard passages 98 as will now be described. Valve spool 30 includes a valve spool bore 106 extending axially thereinto from the end of valve spool 30 that is proximal to camshaft 14. An insert 108 is disposed within valve spool bore 106 such that insert 108 defines a phasing volume 110 and a venting volume 112 such that phasing volume 110 is substantially fluidly segregated from venting volume 112, i.e. phasing volume 110 does not communicate with venting volume 112. Phasing check valve 62 is captured between insert 108 and valve spool bore 106 such that phasing check valve 62 is grounded to insert 108. By way of non-limiting example only, insert 108 may be net-formed by plastic injection molding and may be easily inserted within valve spool bore 106 from the end of valve spool bore 106 that is proximal to valve spring 104 prior to valve spool 30 being inserted into valve bore 64 of camshaft phaser attachment bolt 28. In this way, phasing volume 110 and venting volume 112 are easily and economically formed.

Valve spool 30 also includes a supply land 114 which is sized to fit within valve bore 64 in a close sliding relationship such that oil is substantially prevented from passing between the interface between supply land 114 and valve bore 64 while allowing valve spool 30 to be displaced axially within valve bore 64 substantially uninhibited.

Valve spool 30 also includes a spool annular supply groove 116 that is axially adjacent to supply land 114. A spool supply passage 118 extends radially inward from spool annular supply groove 116 to phasing volume 110 within valve spool bore 106. A supply check valve 120 is captured between insert 108 and valve spool bore 106 within phasing volume 110 such that phasing check valve 62 is grounded to insert 108 in order to allow oil to enter phasing volume 110 from spool supply passage 118 while substantially preventing oil from exiting phasing volume 110 to spool supply passage 118.

Valve spool 30 also includes a lock pin land 122 that is axially adjacent to spool annular supply groove 116. Lock pin land 122 is sized to fit within valve bore 64 in a close sliding relationship such that oil is substantially prevented from passing between the interface between lock pin land 122 and valve bore 64 while allowing valve spool 30 to be displaced axially within valve bore 64 substantially uninhibited. Lock pin land 122 is axially divided by a spool annular lock pin groove 124 such that a spool lock pin passage 126 extends radially inward from spool annular lock pin groove 124 to venting volume 112 within valve spool bore 106, thereby providing fluid communication between spool annular lock pin groove 124 and venting volume 112.

Valve spool 30 also includes a spool annular advance groove 128 that is axially adjacent to lock pin land 122. A spool advance passage 130 extends radially inward from spool annular advance groove 128 to phasing volume 110 within valve spool bore 106 in order to provide fluid communication between spool annular advance groove 128 and phasing volume 110.

Valve spool 30 also includes an advance land 131 that is axially adjacent to spool annular advance groove 128. Advance land 131 is sized to fit within valve bore 64 in a close sliding relationship such that oil is substantially prevented from passing between the interface between advance land 131 and valve bore 64 while allowing valve spool 30 to be displaced axially within valve bore 64 substantially uninhibited.

Valve spool 30 also includes a spool annular recirculation groove 132 that is axially adjacent to advance land 131. A spool recirculation passage 134 extends radially inward from spool annular recirculation groove 132 to phasing volume 110 within valve spool bore 106. Phasing check valve 62 is located in phasing volume 110 in order to allow oil to enter phasing volume 110 from spool recirculation passage 134 while substantially preventing oil from exiting phasing volume 110 to spool recirculation passage 134.

Valve spool 30 also includes a retard land 138 that is axially adjacent to spool annular recirculation groove 132. Retard land 138 is sized to fit within valve bore 64 in a close sliding relationship such that oil is substantially prevented from passing between the interface between retard land 138 and valve bore 64 while allowing valve spool 30 to be displaced axially within valve bore 64 substantially uninhibited.

Valve spool 30 also includes a spool annular retard groove 140 that is axially adjacent to retard land 138. A spool retard passage 142 extends radially inward from spool annular retard groove 140 to phasing volume 110 within valve spool bore 106 in order to provide fluid communication between spool annular retard groove 140 and phasing volume 110.

Valve spool 30 also includes an end land 144 that is axially adjacent to spool annular retard groove 140. End land 144 is sized to fit within valve bore 64 in a close sliding relationship such that oil is substantially prevented from passing between the interface between end land 144 and valve bore 64 while allowing valve spool 30 to be displaced axially within valve bore 64 substantially uninhibited.

Valve spool 30 also includes vent passages 146 which extend radially outward from venting volume 112, thereby allowing oil within venting volume 112 to be vented to valve bore 64 and out of camshaft phaser 12 where it may be drained back to oil source 76. Alternatively, a passage could be formed in camshaft phaser attachment bolt 28 which extends from valve bore 64 to a drain passage in camshaft 14 in order to vent oil within venting volume 112 where it may be drained back to oil source 76.

Figure 5A:
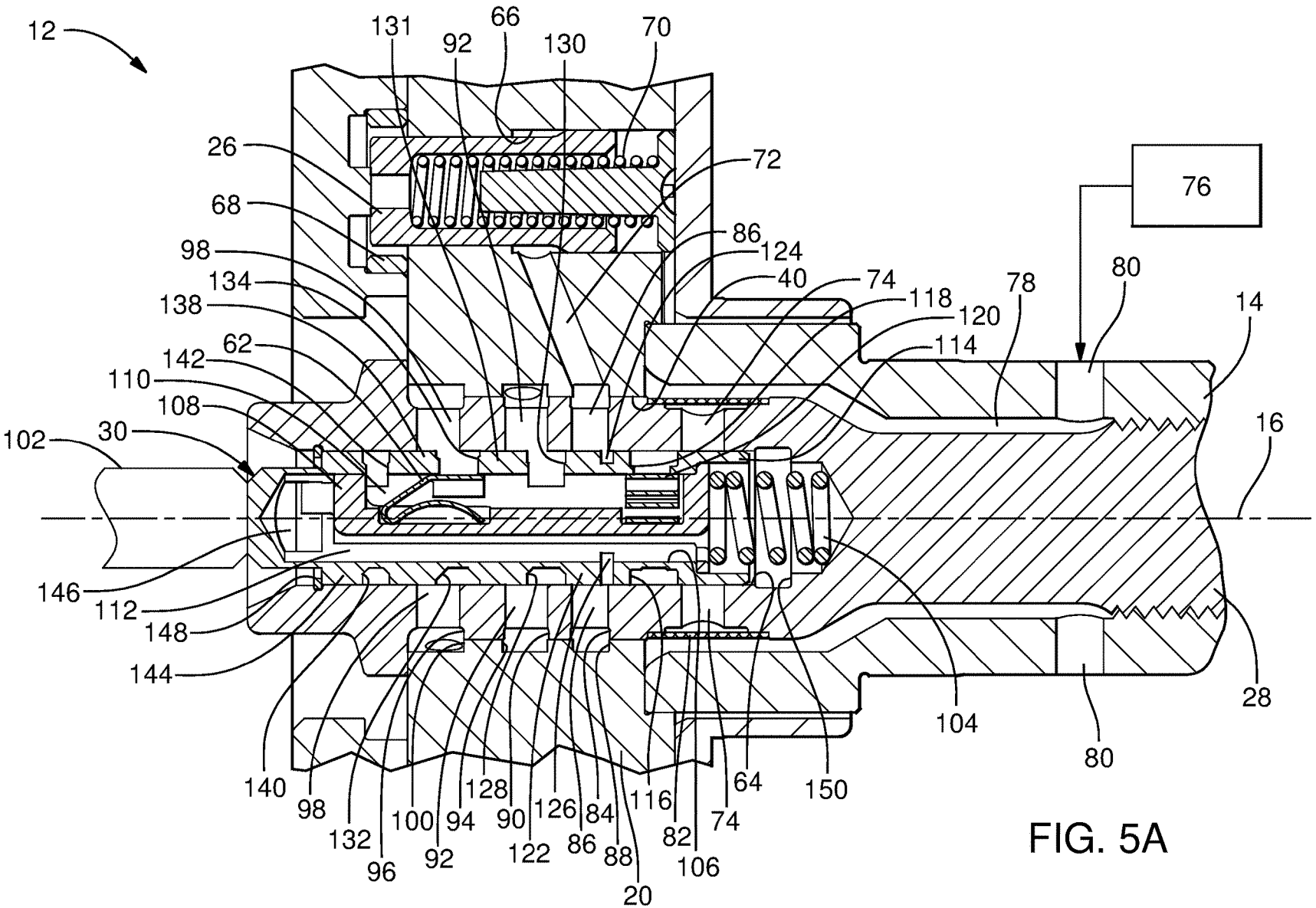
FIG. 5A is an enlarged portion of FIG. 4 showing a valve spool of the camshaft phaser in a default position with a lock pin engaged with a lock pin seat.
Figure 5B:
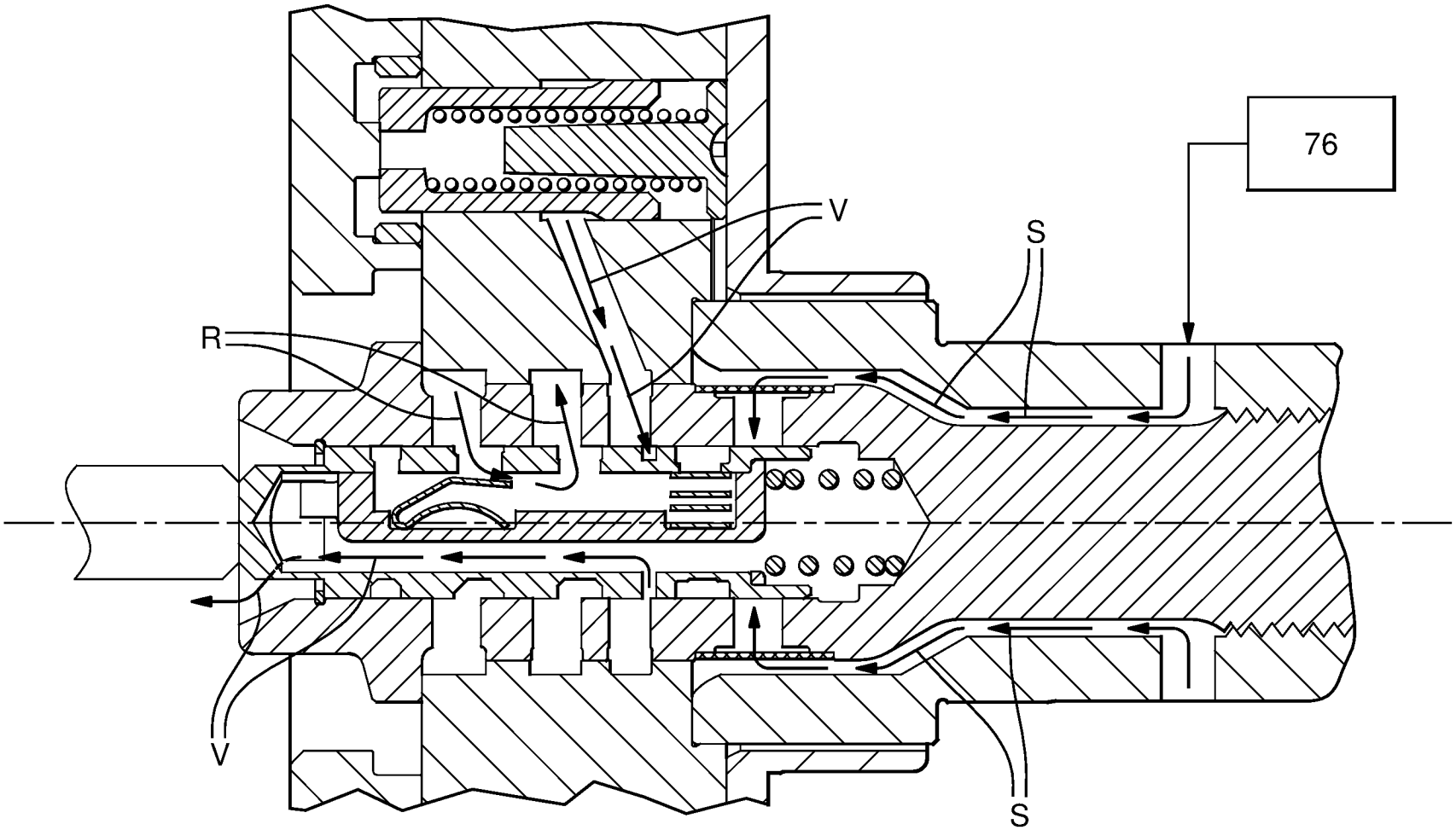
FIG. 5B is the view of FIG. 5A shown with reference numbers removed in order to clearly shown the path of travel of oil.

Actuator 102 may be a solenoid actuator that is selectively energized with an electric current of varying magnitude in order to position valve spool 30 within valve bore 64 at desired axial positions, thereby controlling oil flow to achieve desired operation of camshaft phaser 12. In a default position, when no electric current is supplied to actuator 102 as shown in FIGS. 5A and 5B, valve spring 104 urges valve spool 30 in a direction toward actuator 102 until valve spool 30 axially abuts a first stop member 148, which may be, by way of non-limiting example only, a snap ring within a snap ring groove extending radially outward from valve bore 64. In the default position, supply land 114 is positioned to block bolt supply passages 74, thereby preventing pressurized oil from being supplied to phasing volume 110 from oil source 76. Also in the default position, lock pin land 122 is positioned to align spool annular lock pin groove 124 with bolt lock pin passages 86, thereby allowing oil to be vented from lock pin bore 66 via rotor lock pin passage 72, rotor annular lock pin groove 88, bolt lock pin passages 86, spool annular lock pin groove 124, spool lock pin passage 126, venting volume 112, and vent passages 146 and consequently allowing lock pin spring 70 to urge lock pin 26 toward front cover 24. In the default position, lock pin land 122 also blocks fluid communication between bolt lock pin passages 86 and phasing volume 110. Also in the default position, advance land 131 is positioned to permit fluid communication between bolt advance passages 92 and phasing volume 110 via spool annular advance groove 128 and spool advance passage 130 while retard land 138 is positioned to permit fluid communication between bolt retard passages 98 and phasing volume 110 via spool annular recirculation groove 132, spool recirculation passage 134, and phasing check valve 62. However, fluid communication is prevented from bolt advance passages 92 directly to spool annular recirculation groove 132 and fluid communication is prevented from bolt retard passages 98 directly to spool annular retard groove 140. In this way, torque reversals of camshaft 14 that tend to pressurize oil within retard chambers 44 cause oil to be vented out of retard chambers 44 and to be supplied to advance chambers 42 via rotor retard passages 58, rotor annular retard groove 100, bolt annular retard groove 96, bolt retard passages 98, spool annular recirculation groove 132, spool recirculation passage 134, phasing check valve 62, phasing volume 110, spool advance passage 130, spool annular advance groove 128, bolt advance passages 92, bolt annular advance groove 90, rotor annular advance groove 94, and rotor advance passages 56. However, torque reversals of camshaft 14 that tend to pressurize oil within advance chambers 42 are prevented from venting oil from advance chambers 42 because phasing check valve 62 prevents oil from being supplied to retard chambers 44. Consequently, in the default position, torque reversals of camshaft 14 cause rotor 20 to rotate relative to stator 18 to cause a retard in timing of camshaft 14 relative to the crankshaft, and when lock pin 26 is aligned with lock pin seat 68, lock pin spring 70 urges lock pin 26 into lock pin seat 68 to retain rotor 20 in the predetermined aligned position with stator 18. In FIG. 5B, the reference numbers have been removed for clarity and arrows representing the path of travel of the oil have been included where arrows S represent oil from oil source 76, arrows V represent vented oil from lock pin bore 66, and arrows R represent oil that is being recirculated for rotating rotor 20 relative to stator 18. It should be noted that FIG. 5B shows phasing check valve 62 being opened, but phasing check valve 62 may also be closed depending on the direction of the torque reversion of camshaft 14 at a particular time.

Figure 6A:
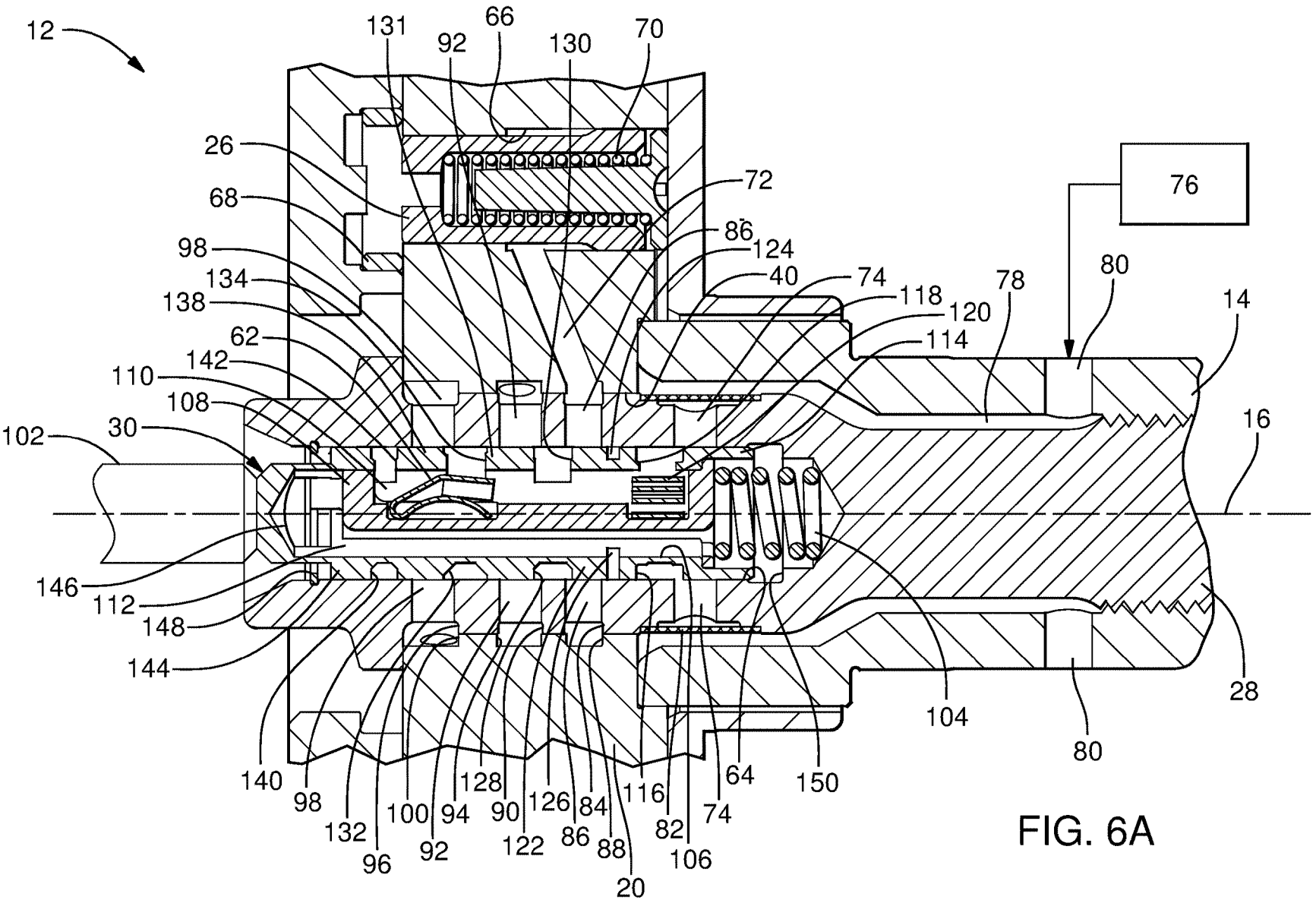
FIG. 6A is the view of FIG. 5A now shown with the valve spool in a retard position now with the lock pin retracted from the lock pin seat.
Figure 6B:
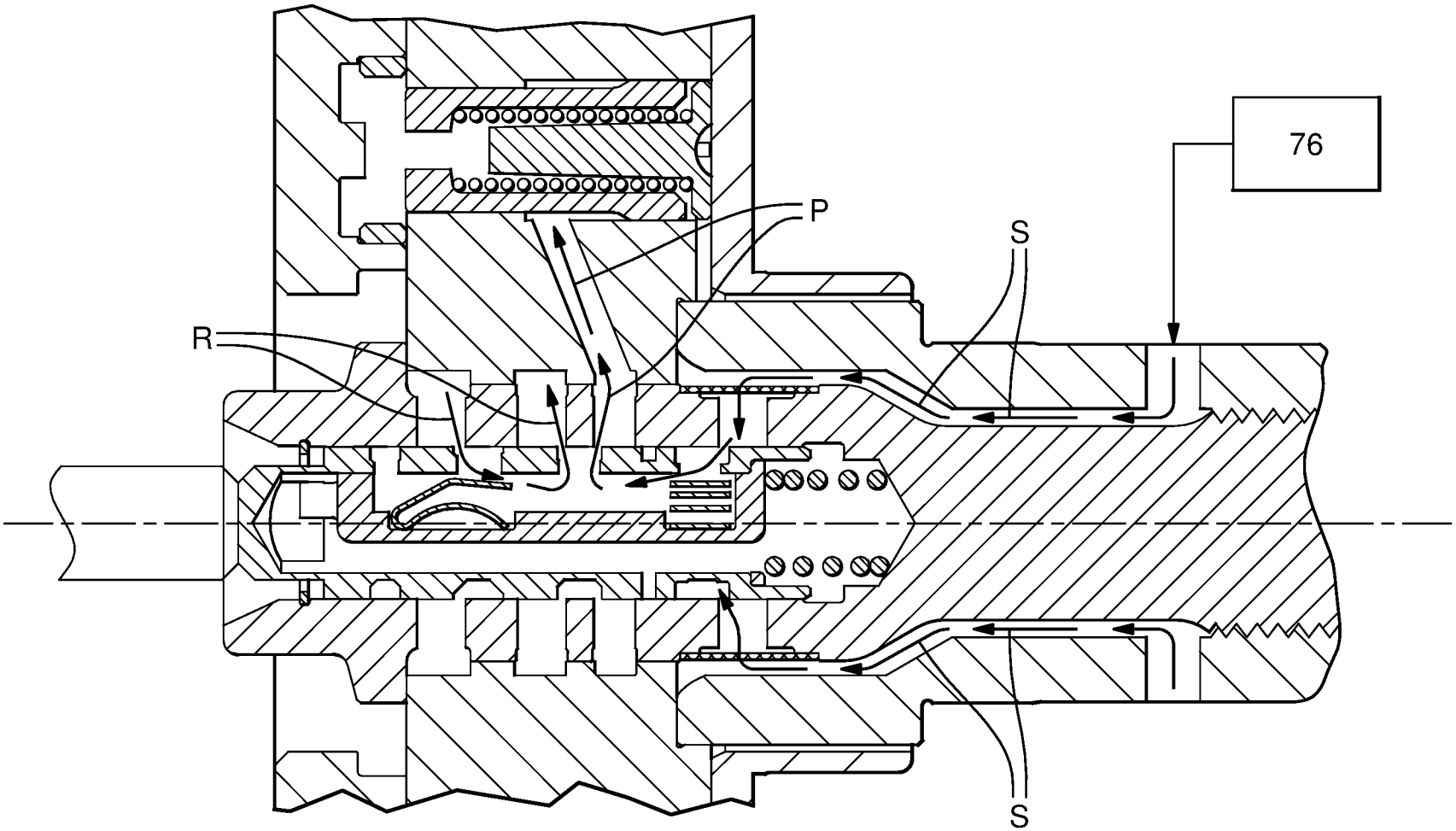
FIG. 6B is the view of FIG. 6A shown with reference numbers removed and arrows added in order to clearly shown the path of travel of oil.

In a retard position, when an electric current of a first magnitude is supplied to actuator 102 as shown in FIGS. 6A and 6B, actuator 102 urges valve spool 30 in a direction toward valve spring 104 thereby causing valve spring 104 to be compressed slightly. In the retard position, supply land 114 is positioned to open bolt supply passages 74, thereby allowing pressurized oil to be supplied to phasing volume 110 through supply check valve 120 from oil source 76 when pressure within phasing volume 110 is lower than the pressure of oil source 76. Also in the retard position, lock pin land 122 is positioned to prevent fluid communication between bolt lock pin passages 86 and spool annular lock pin groove 124, thereby preventing oil from being vented from lock pin bore 66. In the retard position, lock pin land 122 also opens fluid communication between bolt lock pin passages 86 and phasing volume 110, thereby allowing pressurized oil to be supplied to lock pin bore 66 via spool advance passage 130, spool annular advance groove 128, bolt lock pin passages 86, bolt annular lock pin groove 84, rotor annular lock pin groove 88, and rotor lock pin passage 72, and as a result, lock pin 26 compresses lock pin spring 70 and lock pin 26 is retracted from lock pin seat 68. It should be noted that by supplying oil to lock pin bore 66 from phasing volume 110, a separate dedicated supply for retracting lock pin 26 from lock pin seat 68 is not required. Also in the retard position, advance land 131 is positioned to permit fluid communication between bolt advance passages 92 and phasing volume 110 via spool annular advance groove 128 and spool advance passage 130 while retard land 138 is positioned to permit fluid communication between bolt retard passages 98 and phasing volume 110 via spool annular recirculation groove 132, spool recirculation passage 134, and phasing check valve 62. However, fluid communication is prevented from bolt advance passages 92 directly to spool annular recirculation groove 132 and fluid communication is prevented from bolt retard passages 98 directly to spool annular retard groove 140. In this way, torque reversals of camshaft 14 that tend to pressurize oil within retard chambers 44 cause oil to be vented out of retard chambers 44 and to be supplied to advance chambers 42 via rotor retard passages 58, rotor annular retard groove 100, bolt annular retard groove 96, bolt retard passages 98, spool annular recirculation groove 132, spool recirculation passage 134, phasing check valve 62, phasing volume 110, spool advance passage 130, spool annular advance groove 128, bolt advance passages 92, bolt annular advance groove 90, rotor annular advance groove 94, and rotor advance passages 56. However, torque reversals of camshaft 14 that tend to pressurize oil within advance chambers 42 are prevented from venting oil from advance chambers 42 because phasing check valve 62 prevents oil from being supplied to retard chambers 44. Consequently, in the retard position, torque reversals of camshaft 14 cause rotor 20 to rotate relative to stator 18 to cause a retard in timing of camshaft 14 relative to the crankshaft. It should be noted that supply check valve 120 prevents oil from being communicated to oil source 76 from phasing volume 110 when torque reversals of camshaft 14 produce oil pressures that are greater than the pressure produced by oil source 76. In FIG. 6B, the reference numbers have been removed for clarity and arrows representing the path of travel of the oil have been included where arrows S represent oil from oil source 76, arrows R represent oil that is being recirculated for rotating rotor 20 relative to stator 18, and arrows P represent oil that is pressurized to retract lock pin 26 from lock pin seat 68. It should be noted that FIG. 6B shows phasing check valve 62 being opened, but phasing check valve 62 may also be closed depending on the direction of the torque reversion of camshaft 14 at a particular time. It should also be noted that supply check valve 120 is shown open in FIG. 6B, but may typically remain closed unless lock pin 26 is in the process of being retracted from lock pin seat 88.

Figure 7A:
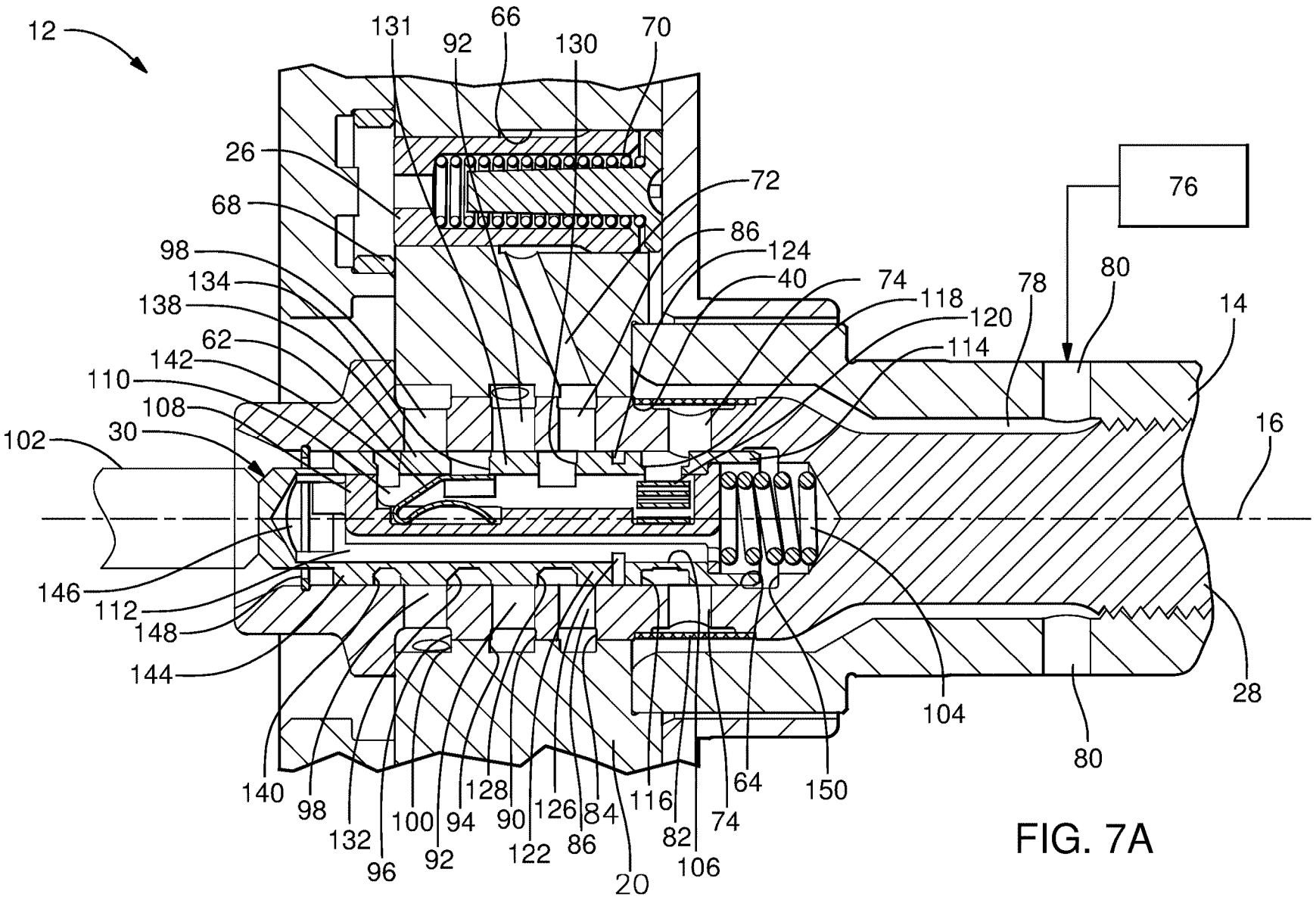
FIG. 7A is the view of FIG. 5A now shown with the valve spool in a hold position now with the lock pin retracted from the lock pin seat.
Figure 7B:
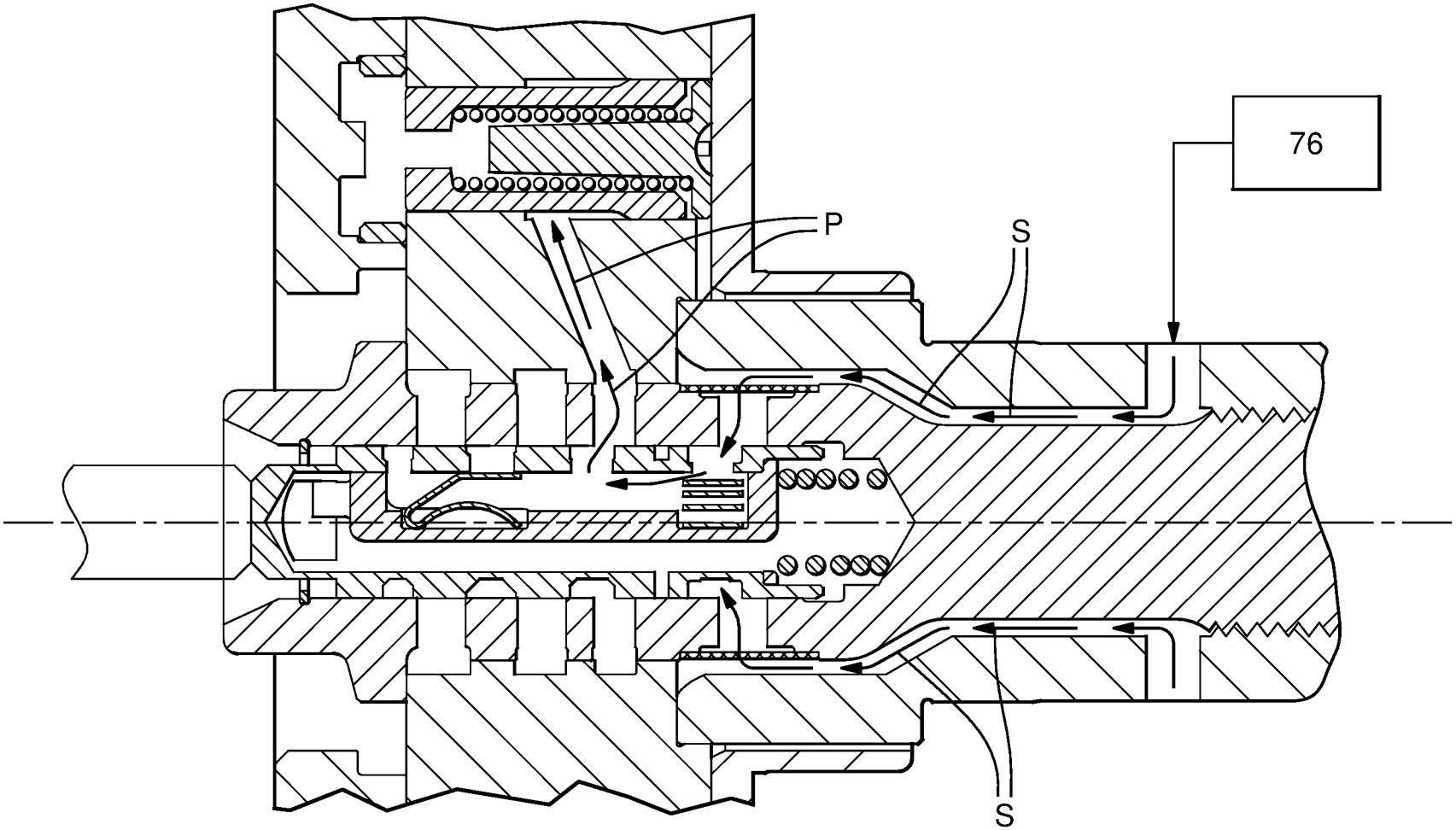
FIG. 7B is the view of FIG. 7A shown with reference numbers removed and arrows added in order to clearly shown the path of travel of oil.

In a hold position, when an electric current of a second magnitude is supplied to actuator 102 as shown in FIGS. 7A and 7B, actuator 102 urges valve spool 30 in a direction toward valve spring 104 thereby causing valve spring 104 to be compressed slightly more than in the retard position. In the hold position, supply land 114 is positioned to open bolt supply passages 74, thereby allowing pressurized oil to be supplied to phasing volume 110 through supply check valve 120 from oil source 76 when pressure within phasing volume 110 is lower than the pressure of oil source 76. Also in the retard position, lock pin land 122 is positioned to prevent fluid communication between bolt lock pin passages 86 and spool annular lock pin groove 124, thereby preventing oil from being vented from lock pin bore 66. In the hold position, lock pin land 122 also opens fluid communication between bolt lock pin passages 86 and phasing volume 110, thereby allowing pressurized oil to be supplied to lock pin bore 66 via spool advance passage 130, spool annular advance groove 128, bolt lock pin passages 86, bolt annular lock pin groove 84, rotor annular lock pin groove 88, and rotor lock pin passage 72, and as a result, lock pin 26 compresses lock pin spring 70 and lock pin 26 is retracted from lock pin seat 68. Also in the hold position, advance land 131 is positioned to block fluid communication between bolt advance passages 92 and spool annular advance groove 128 via spool advance passage 130 while providing restricted fluid communication between bolt advance passages 92 and spool annular recirculation groove 132. Similarly, in the hold position, retard land 138 is positioned to block fluid communication between bolt retard passages 98 and spool annular retard groove 140 via spool retard passage 142 while providing restricted fluid communication between bolt retard passages 98 and spool annular recirculation groove 132. By providing restricted fluid communication between bolt advance passages 92 and spool annular recirculation groove 132 and between bolt retard passages 98 and spool annular recirculation groove 132, the rotational position of rotor 20 and stator 18 is substantially maintained in the hold position. In FIG. 7B, the reference numbers have been removed for clarity and arrows representing the path of travel of the oil have been included where arrows S represent oil from oil source 76 and arrows P represent oil that is pressurized to retract lock pin 26 from lock pin seat 68. It should be noted that FIG. 7B shows supply check valve 120 being open, but may typically remain closed unless lock pin 26 is in the process of being retracted from lock pin seat 88.

Figure 8A:
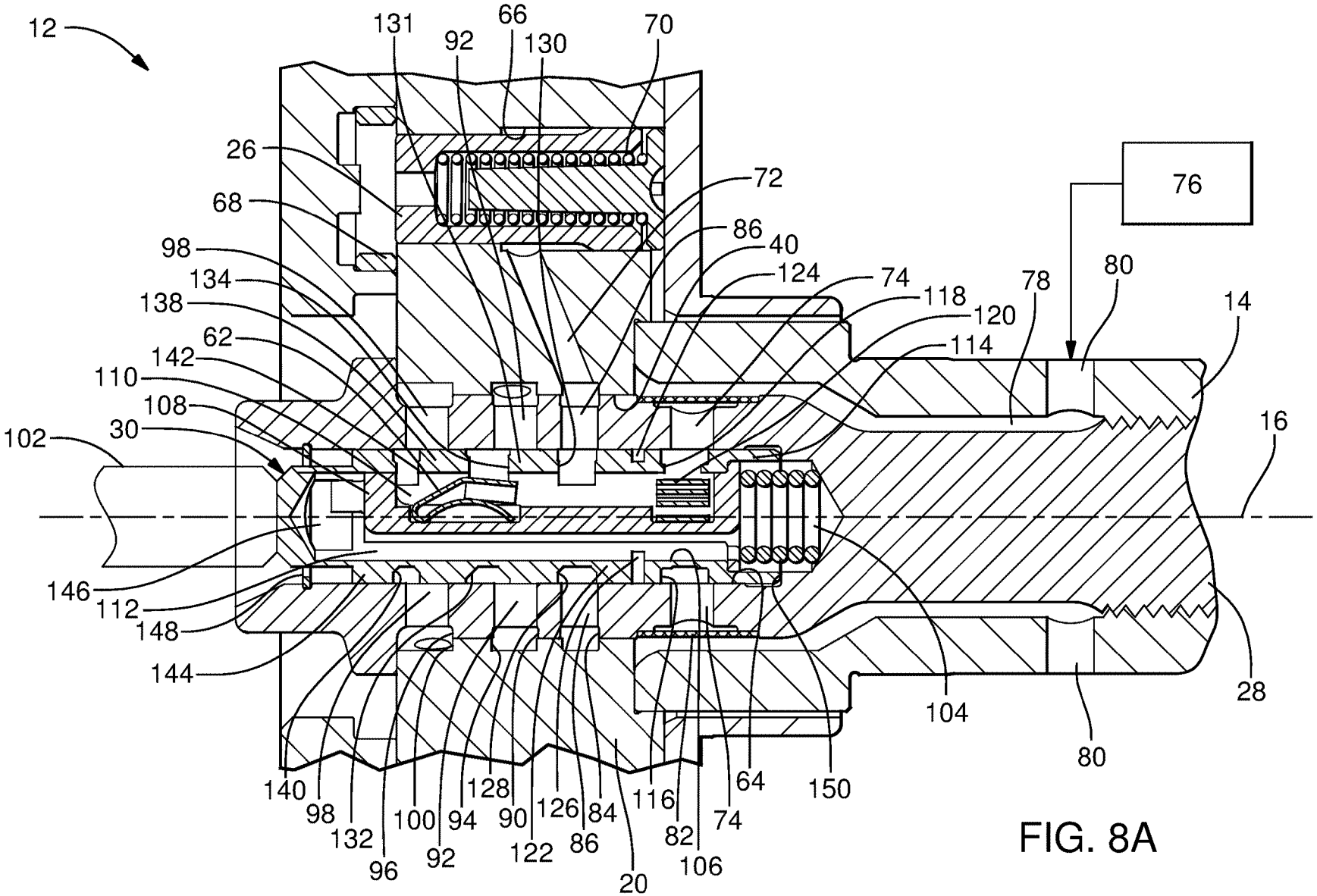
FIG. 8A is the view of FIG. 5A now shown with the valve spool in an advance position now with the lock pin retracted from the lock pin seat.
Figure 8B:
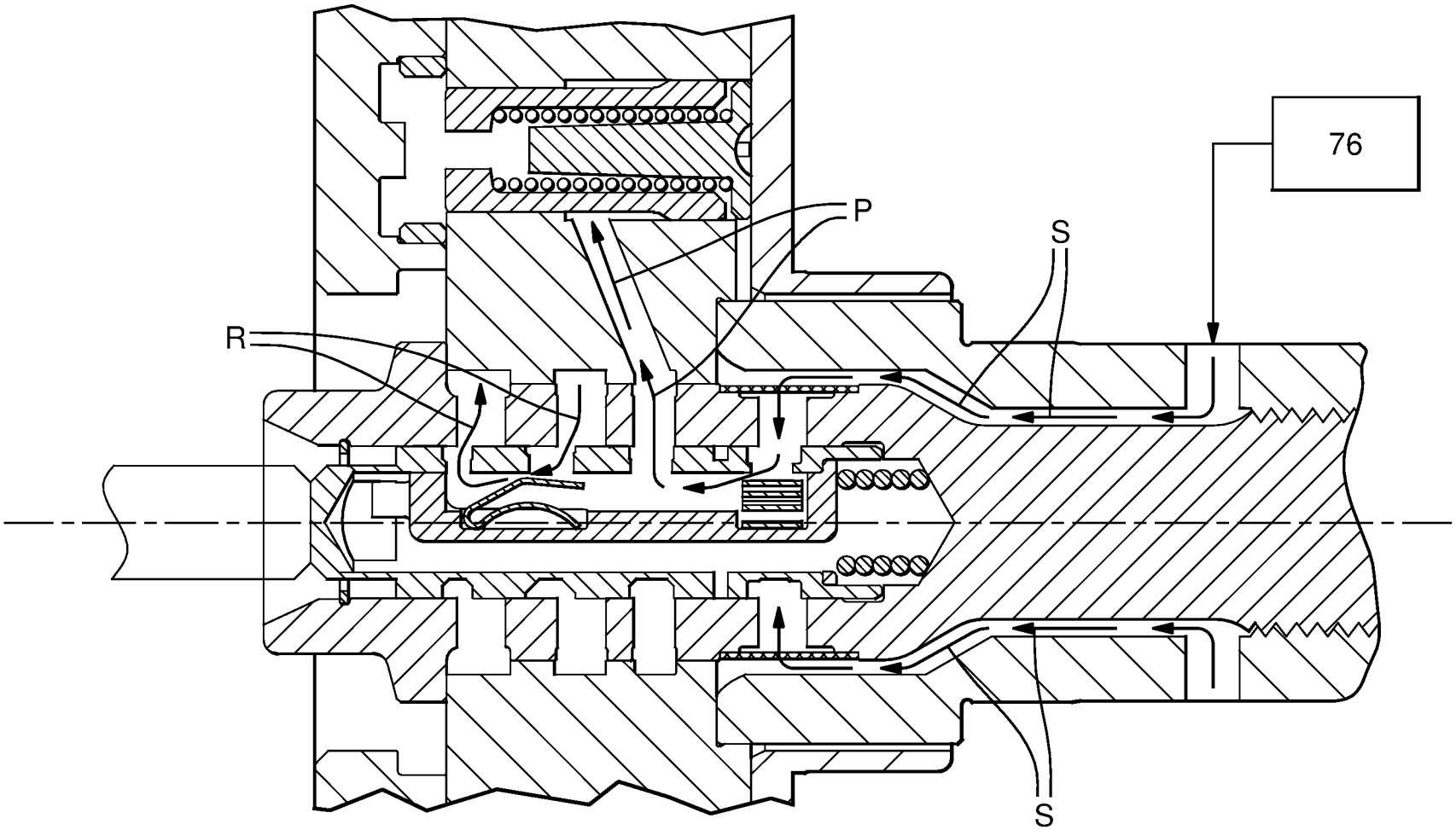
FIG. 8B is the view of FIG. 8A shown with reference numbers removed and arrows added in order to clearly shown the path of travel of oil.

In an advance position, when an electric current of a third magnitude is supplied to actuator 102 as shown in FIGS. 8A and 8B, actuator 102 urges valve spool 30 in a direction toward valve spring 104 thereby causing valve spring 104 to be compressed slightly more than in the hold position until valve spool 30 abuts a second stop member 150, which may be, by way of non-limiting example only, a shoulder formed in valve bore 64. In the advance position, supply land 114 is positioned to open bolt supply passages 74, thereby allowing pressurized oil to be supplied to phasing volume 110 through supply check valve 120 from oil source 76 when pressure within phasing volume 110 is lower than the pressure of oil source 76. Also in the advance position, lock pin land 122 is positioned to prevent fluid communication between bolt lock pin passages 86 and spool annular lock pin groove 124, thereby preventing oil from being vented from lock pin bore 66. In the advance position, lock pin land 122 also opens fluid communication between bolt lock pin passages 86 and phasing volume 110, thereby allowing pressurized oil to be supplied to lock pin bore 66 via spool advance passage 130, spool annular advance groove 128, bolt lock pin passages 86, bolt annular lock pin groove 84, rotor annular lock pin groove 88, and rotor lock pin passage 72, and as a result, lock pin 26 compresses lock pin spring 70 and lock pin 26 is retracted from lock pin seat 68. Also in the advance position, advance land 131 is positioned to permit fluid communication between bolt advance passages 92 and phasing volume 110 via spool annular recirculation groove 132, spool recirculation passage 134, and phasing check valve 62 while retard land 138 is positioned to permit fluid communication between bolt retard passages 98 and phasing volume 110 via spool annular retard groove 140 and spool retard passage 142. However, fluid communication is prevented from bolt advance passages 92 directly to spool annular advance groove 128 and fluid communication is prevented from bolt retard passages 98 directly to spool annular recirculation groove 132. In this way, torque reversals of camshaft 14 that tend to pressurize oil within advance chambers 42 cause oil to be vented out of advance chambers 42 and to be supplied to retard chambers 44 via rotor advance passages 56, rotor annular advance groove 94, bolt annular advance groove 90, bolt advance passages 92, spool annular recirculation groove 132, spool recirculation passage 134, phasing check valve 62, phasing volume 110, spool retard passage 142, spool annular retard groove 140, bolt retard passages 98, bolt annular retard groove 96, rotor annular retard groove 100, and rotor retard passages 58. However, torque reversals of camshaft 14 that tend to pressurize oil within retard chambers 44 are prevented from venting oil from retard chambers 44 because phasing check valve 62 prevents oil from being supplied to advance chambers 42. Consequently, in the advance position, torque reversals of camshaft 14 cause rotor 20 to rotate relative to stator 18 to cause an advance in timing of camshaft 14 relative to the crankshaft. It should be noted that supply check valve 120 prevents oil from being communicated to oil source 76 from phasing volume 110 when torque reversals of camshaft 14 produce oil pressures that are greater than the pressure produced by oil source 76. In FIG. 8B, the reference numbers have been removed for clarity and arrows representing the path of travel of the oil have been included where arrows S represent oil from oil source 76, arrows R represent oil that is being recirculated for rotating rotor 20 relative to stator 18, and arrows P represent oil that is pressurized to retract lock pin 26 from lock pin seat 68. It should be noted that FIG. 8B shows phasing check valve 62 being opened, but phasing check valve 62 may also be closed depending on the direction of the torque reversion of camshaft 14 at a particular time. It should also be noted that supply check valve 120 is shown open in FIG. 8B, but may typically remain closed unless lock pin 26 is in the process of being retracted from lock pin seat 88.

As shown in the figures, phasing check valve 62 and supply check valve 120 may each be simple one piece devices that are made of formed sheet metal that is resilient and compliant and captured between insert 108 and valve spool bore 106. While phasing check valve 62 and supply check valve 120 have been shown as being distinct elements, it should now be understood that phasing check valve 62 and supply check valve 120 may be made from a single piece of formed sheet metal such that phasing check valve 62 and supply check valve 120 share a common portion that engages insert 108. It should also now be understood that one or both of phasing check valve 62 and supply check valve 120 may take numerous other forms known in the art of check valves and may include multiple elements such as coil compression springs and balls.

Figure 9:
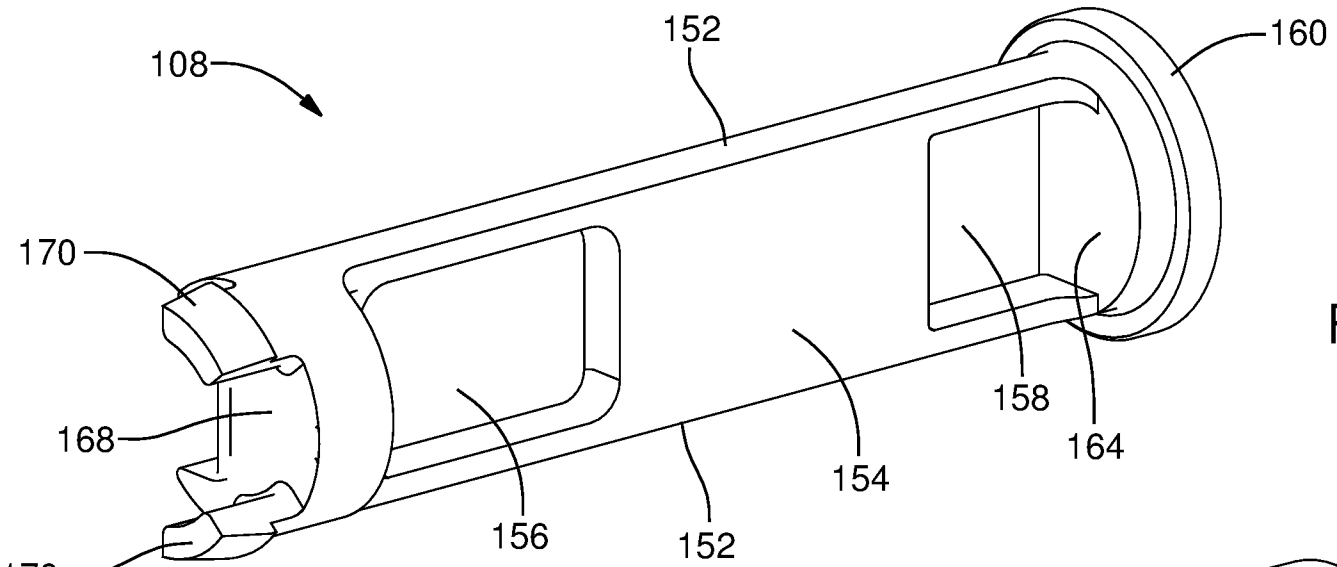
FIGS. 9 and 10 are isometric views of an insert of a valve spool of the camshaft phaser in accordance with the present invention.
Figure 10:
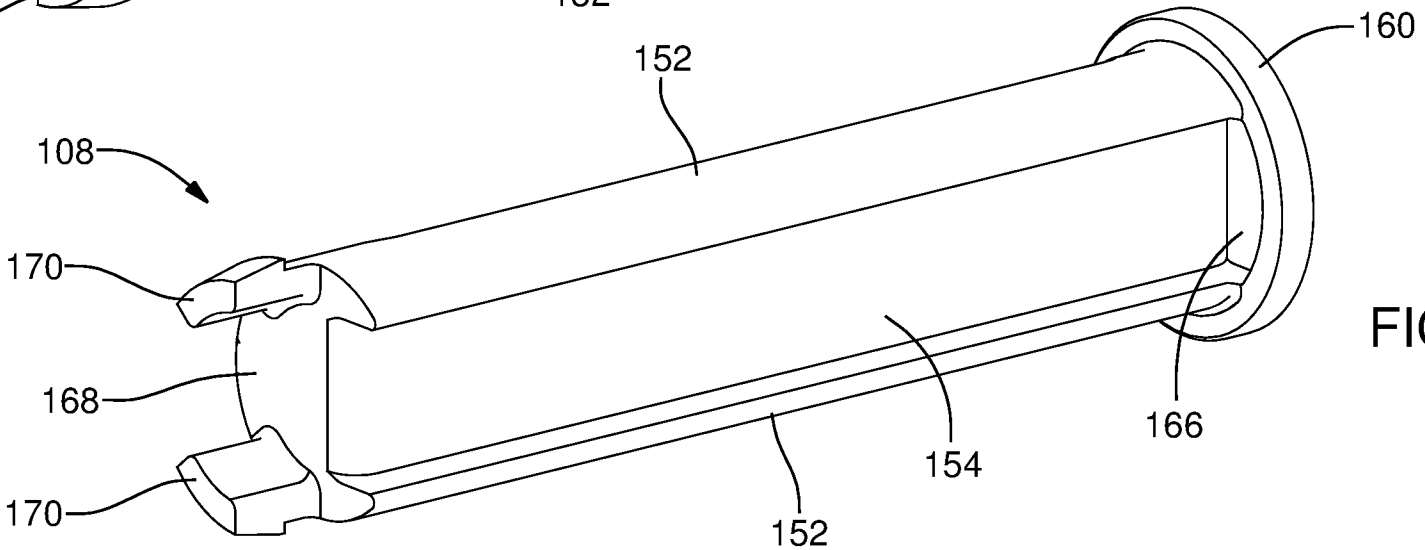
Figure 11:
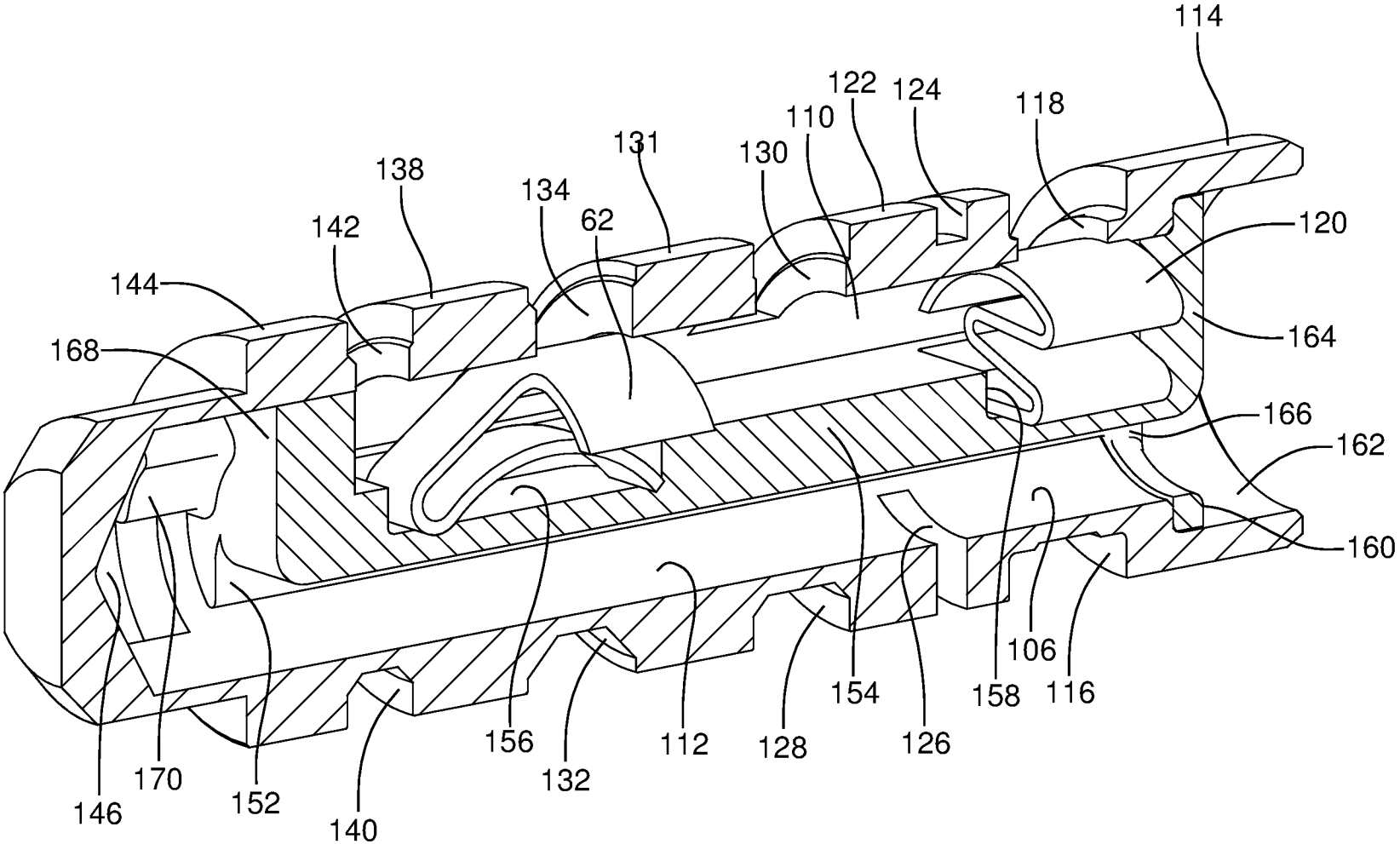
FIG. 11 is an isometric cross-sectional view of the valve spool and the insert of the camshaft phaser.
Figure 12:
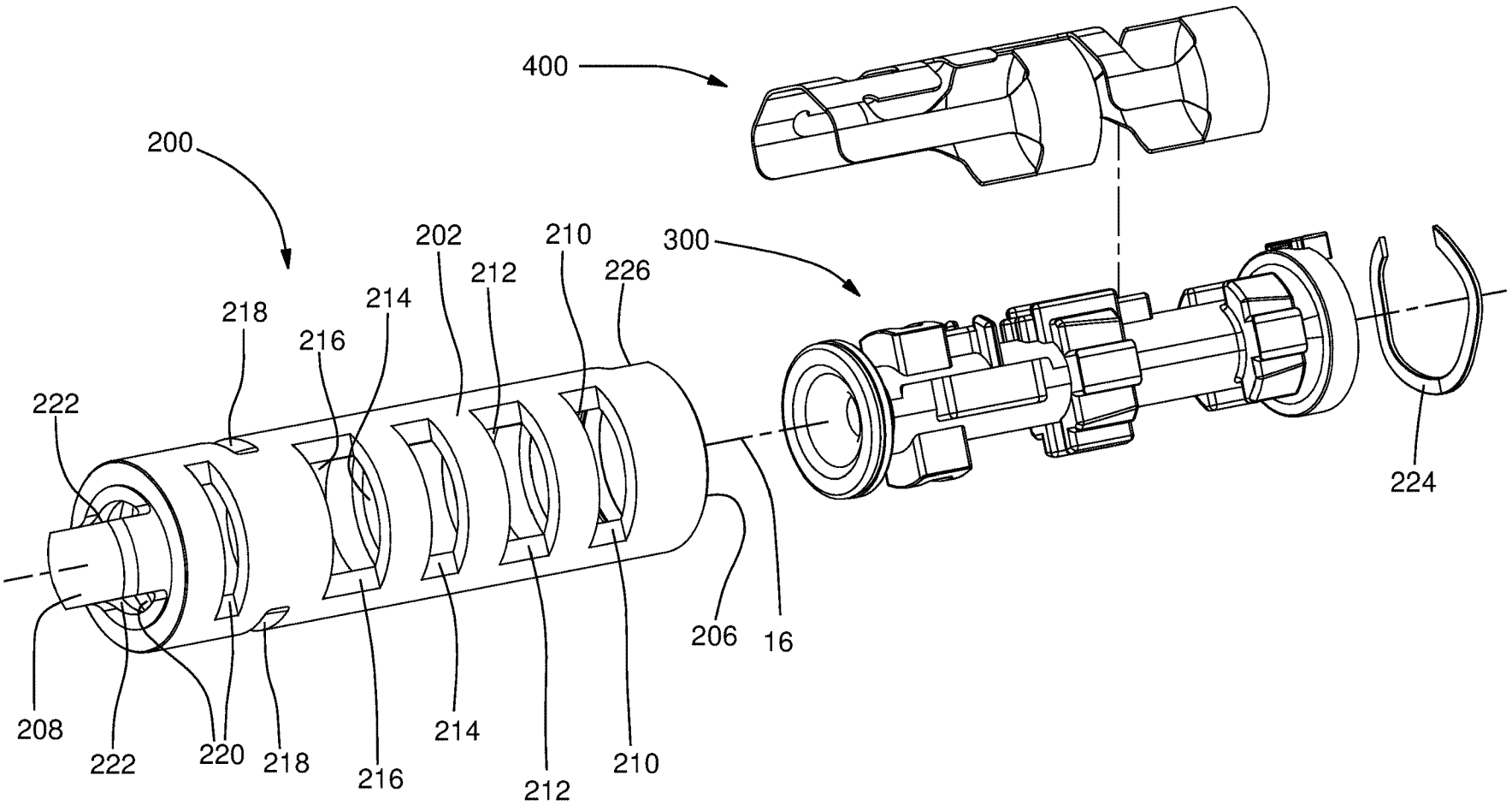
FIG. 12 is an exploded isometric view of a valve spool, an insert, and a check valve in accordance with the present invention for use in the camshaft phaser of FIG. 1.
Figure 13:
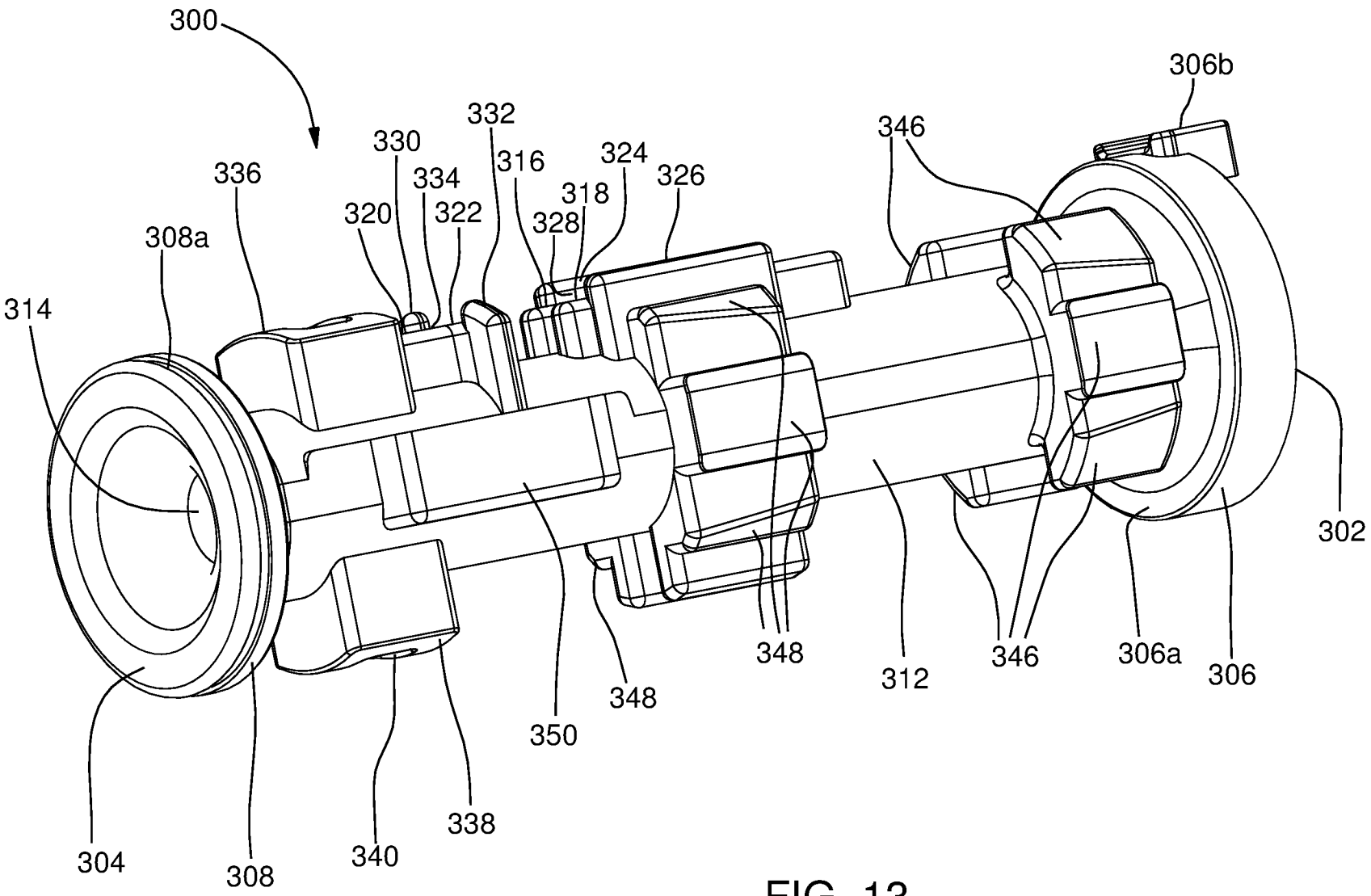
FIG. 13 is an isometric view of the insert of FIG. 12.
Figure 14:
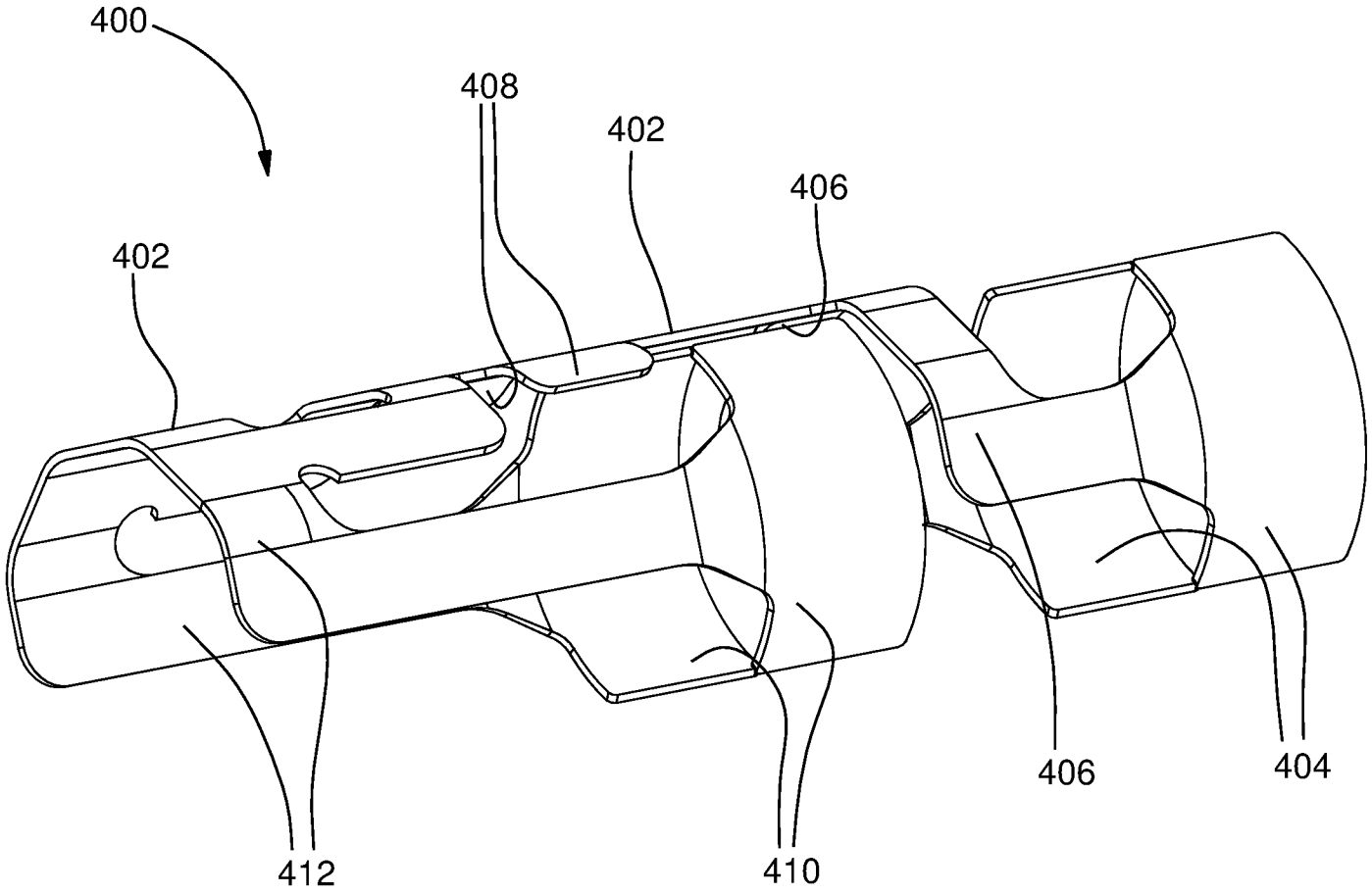
FIG. 14 is an isometric view of the check valve of FIG. 12.
Figure 15:
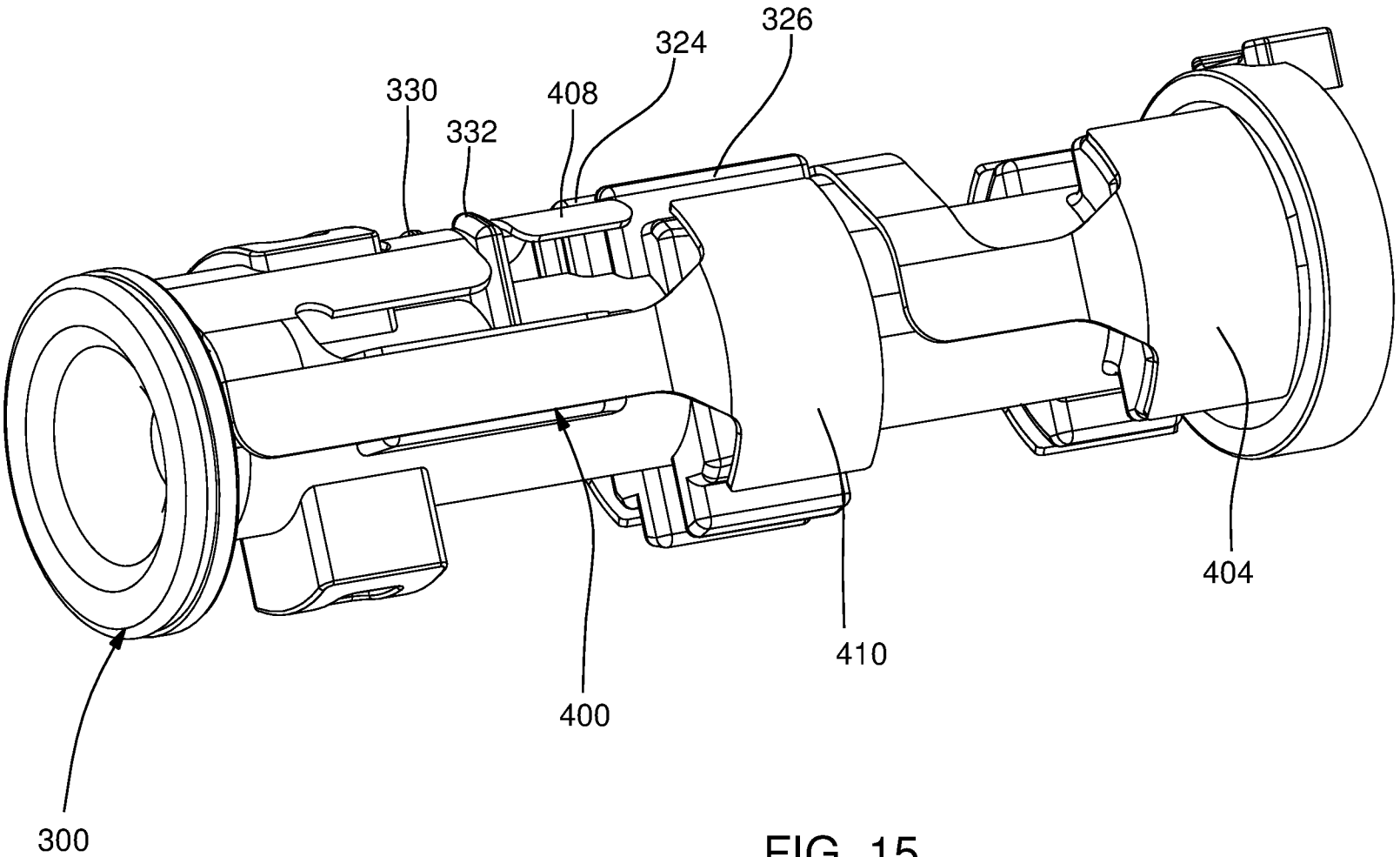
FIG. 15 is an isometric view of the check valve of FIG. 12 assembled to the insert.
Figure 16:
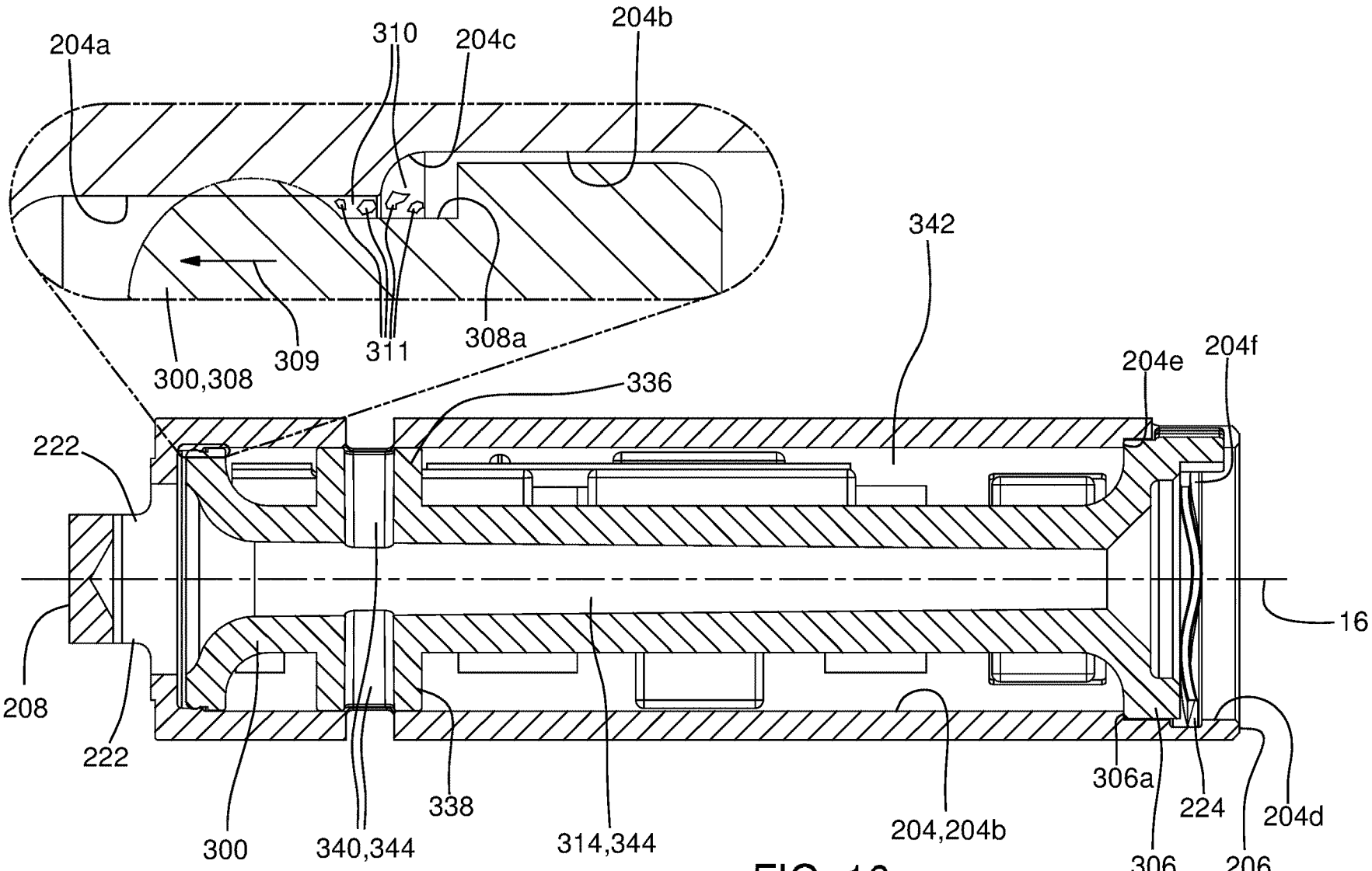
FIG. 16 is an axial cross-sectional view of the valve spool, the insert, and the check valve of FIG. 12.
Figure 17:
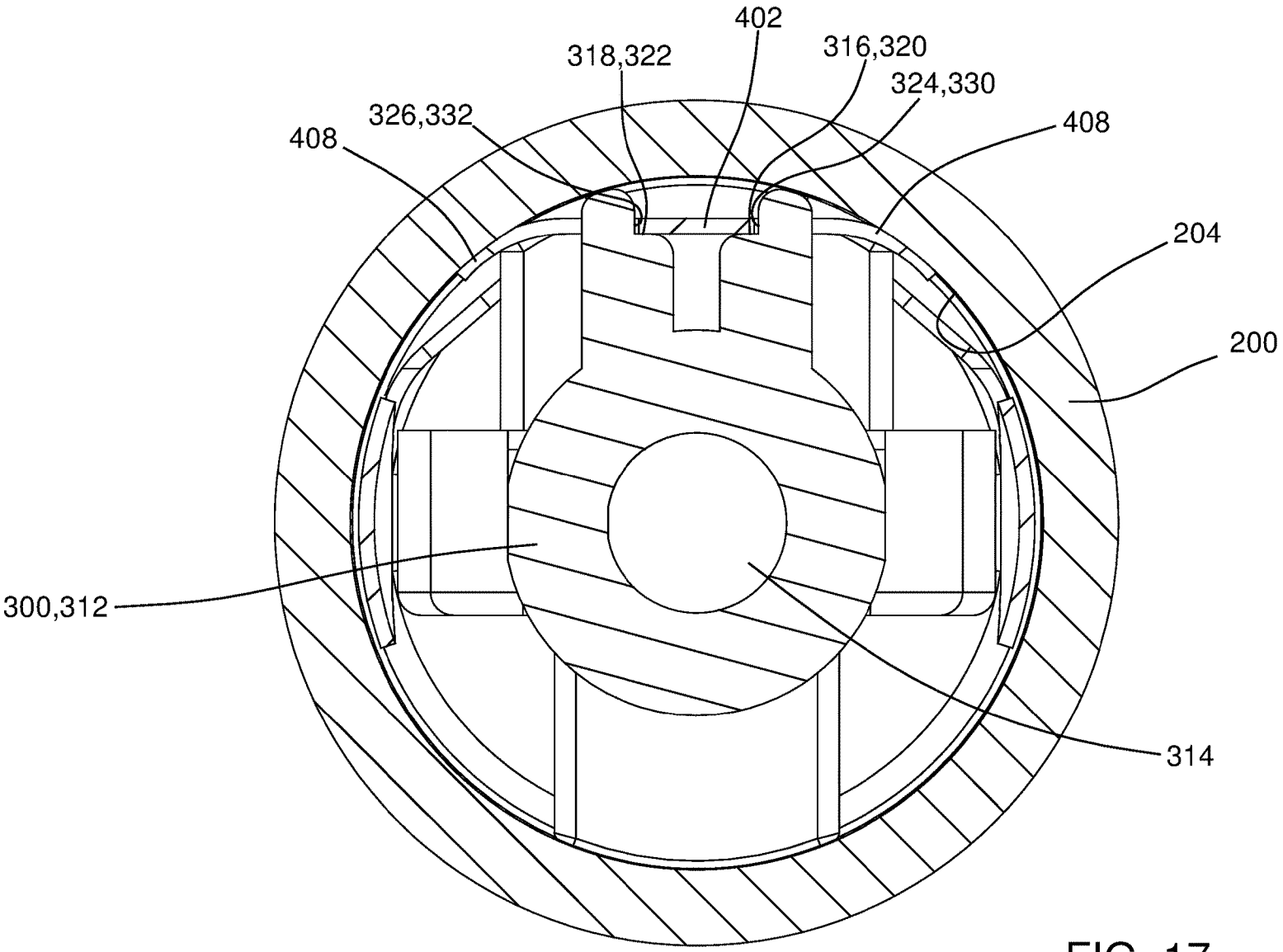
FIG. 17 is a radial cross-sectional view of the valve spool, the insert, and the check valve of FIG. 12.

Insert 108 will now be describe with additional reference to FIGS. 9-11 where FIGS. 9 and 10 are isometric views of insert 108 and FIG. 11 is an isometric axial cross-sectional view of valve spool 30 and insert 108. Insert 108 includes a pair of opposing insert sidewalls 152 which extend axially within valve spool bore 106. Insert sidewalls 152 are contoured to conform to valve spool bore 106 and are spaced apart to allow insert sidewalls 152 to sealingly engage valve spool bore 106 to substantially prevent oil from passing between the interface of insert sidewalls 152 and valve spool bore 106. An insert dividing wall 154 traverses insert sidewalls 152 such that one side of insert dividing wall 154 is laterally offset from valve spool bore 106 and faces toward phasing volume 110 while the other side of insert dividing wall 154 is laterally offset from valve spool bore 106 and faces toward venting volume 112. A phasing check valve pocket 156 and a supply check valve pocket 158 may be defined within the side of insert dividing wall 154 that faces toward phasing volume 110 in order to receive portions of phasing check valve 62 and supply check valve 120 respectively, thereby positively positioning phasing check valve 62 and supply check valve 120 within phasing volume 110. One end of insert sidewalls 152 terminate at a circular insert base 160 which is received within a valve spool counter bore 162 of valve spool bore 106. An insert base end wall 164 is defined between insert base 160 and insert dividing wall 154 to close off one end of phasing volume 110 while an insert base passage 166 is defined between insert base 160 and insert dividing wall 154 to open venting volume 112 to the portion of valve bore 64 that contains valve spring 104 in order to provide a vent path for any oil that may leak thereinto. Insert base 160 may also serve as a spring seat to valve spring 104. An insert end wall 168 is defined at the other end of insert sidewalls 152 in order to close off the other end of phasing volume 110. It should be noted that insert end wall 168 keeps venting volume 112 open to vent passages 146. A pair of insert retention members 170 may extend axially from insert end wall 168 to snap over and engage end land 144 in order to axially retain insert 108 and also to radially orient insert 108 within valve spool bore 106. Alternatively, insert retention members 170 may be omitted because valve spring 104 may be sufficient to retain insert 108 within valve spool bore 106. In the case that insert retention members 170 are omitted, other features may be needed to radially orient insert 108 within valve spool bore 106.

Figure 2:
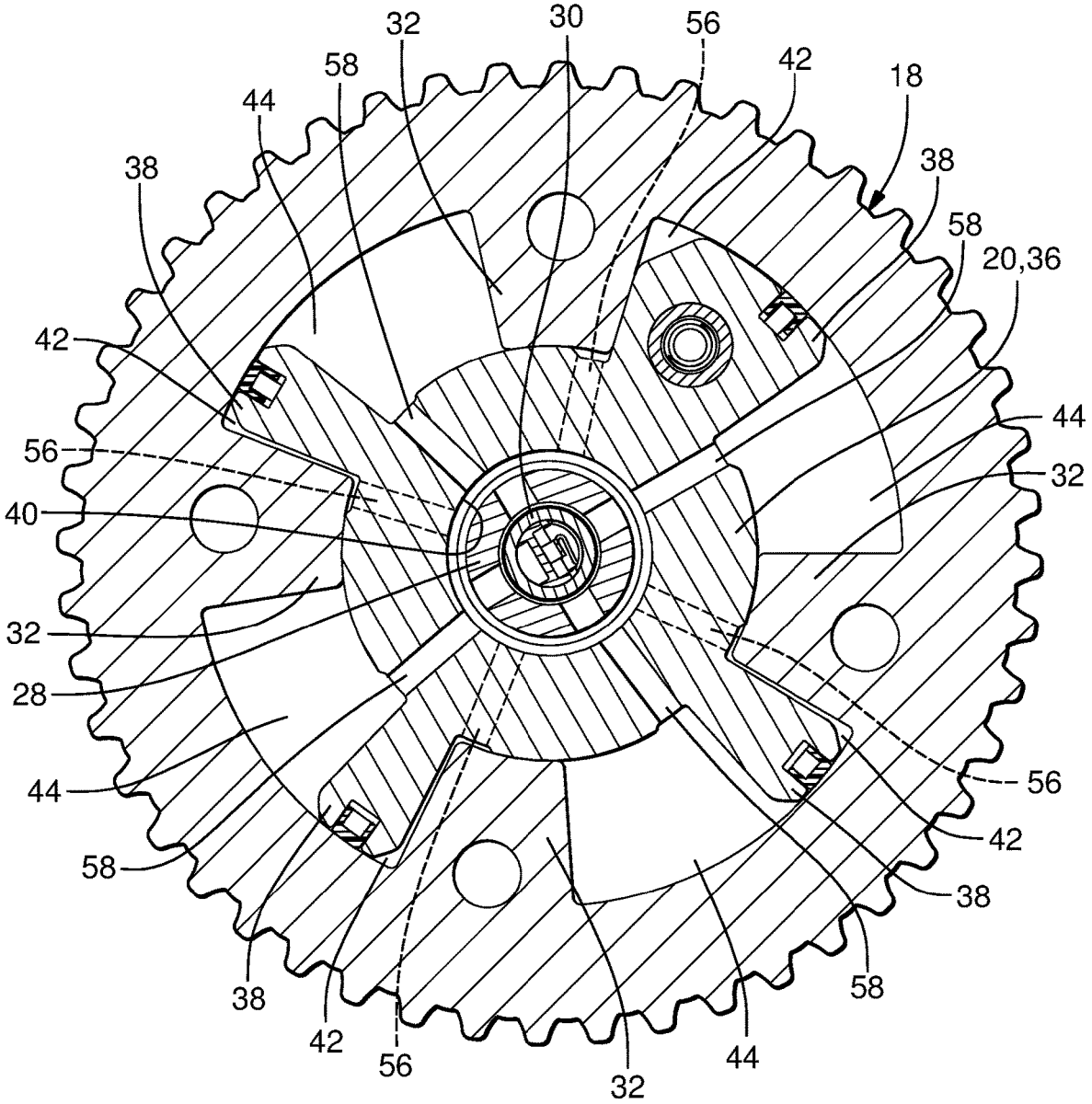
FIG. 2 is a radial cross-sectional view of the camshaft phaser.
Figure 3:
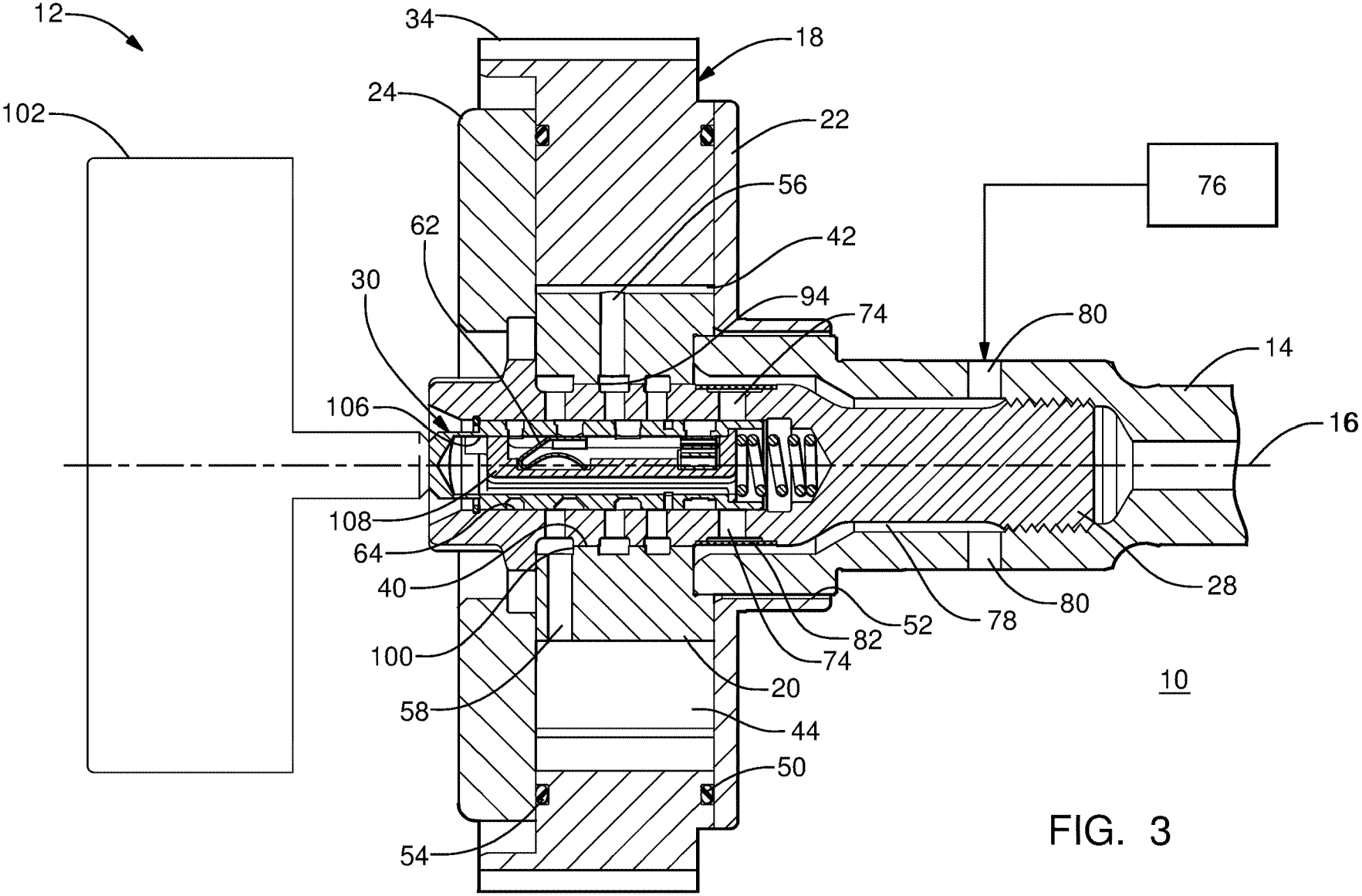
FIG. 3. is a cross-sectional view of the camshaft phaser taken through advance and retard passages of a rotor of the camshaft phaser.
Figure 4:
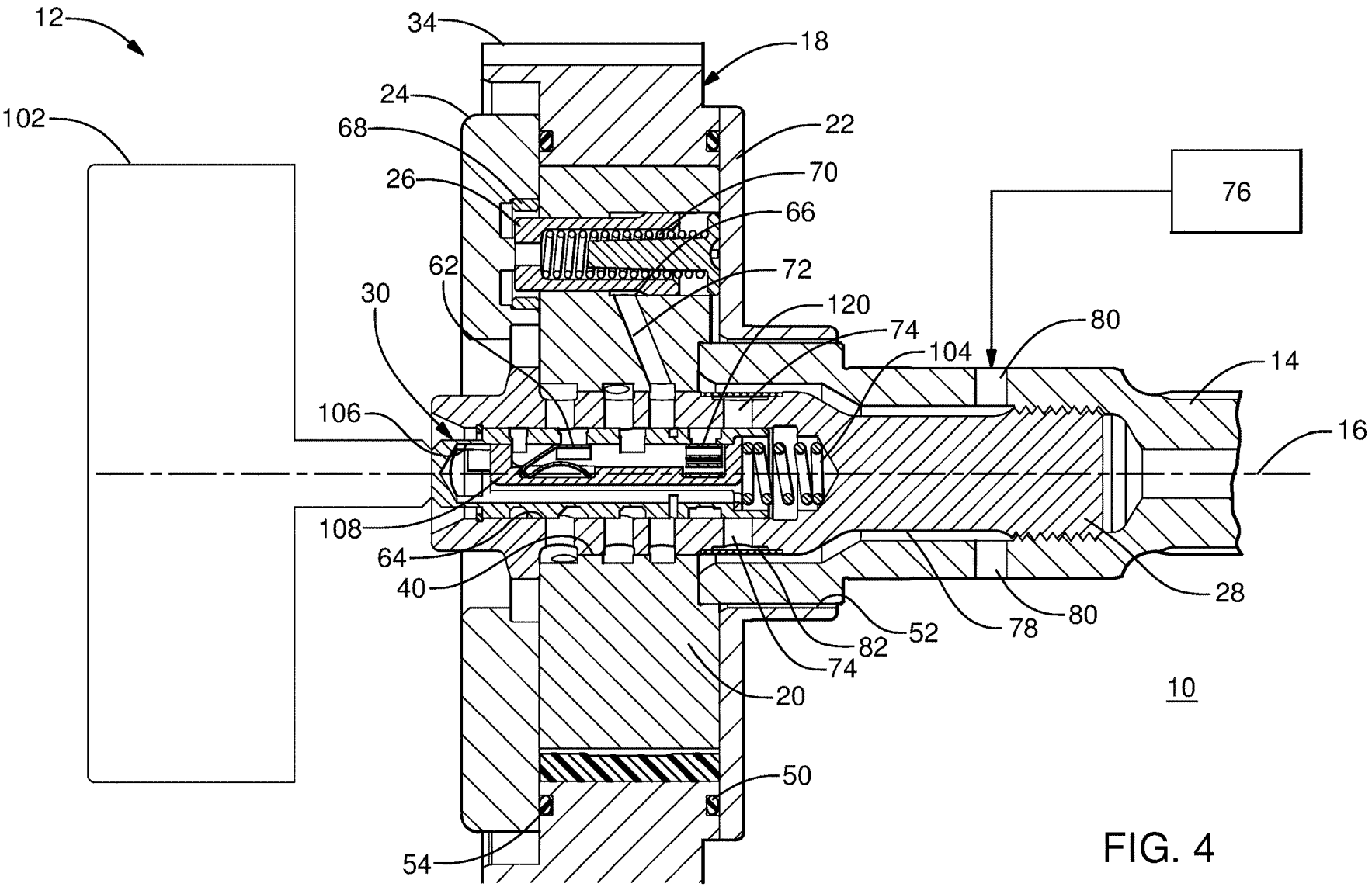
FIG. 4. is a cross-sectional view of the camshaft phaser taken through a lock pin of the camshaft phaser.

While camshaft phaser 12 has been described as defaulting to full advance, it should now be understood that camshaft phaser 12 may alternatively default to full retard by simply rearranging oil passages. Similarly, while full advance has been described as full counterclockwise rotation of rotor 20 within stator 18 as shown in FIG. 2, it should also now be understood that full advance may alternatively be full clockwise rotation of rotor 20 within stator 18 depending on whether camshaft phaser 12 is mounted to the front of internal combustion engine 10 (shown in the figures) or to the rear of internal combustion engine 10.

While camshaft phaser 12 has been illustrated and described as including phasing check valve 62, it is also contemplated that phasing check valve 62 may be omitted, and rotation of rotor 20 relative to stator 18 may be accomplished using oil supplied by oil source 76 to 'phasing volume 110. When phasing check valve 62 is omitted, valve spool 30 is modified such that supply land 114 does not prevent fluid communication between oil source 76 in the default position and rotor advance passages 56 communicate with venting volume 112 rather than phasing volume 110 in the default position.

While camshaft phaser attachment bolt 28 has been described herein as including grooves on the outer periphery thereof which are aligned with corresponding grooves formed in rotor central through bore 40 of rotor 20, it should now be understood that the grooves on camshaft phaser attachment bolt 28 could be omitted and the grooves formed in rotor central through bore 40 could be used to serve the same function. Similarly, the grooves formed in rotor central through bore 40 could be omitted and the grooves on camshaft phaser attachment bolt 28 could be used to serve the same function.

Now with reference to FIGS. 12-17, an alternative valve spool 200, insert 300, and check valve 400 are illustrated in accordance with the present invention where valve spool 200 replaces valve spool 30, insert 300 replaces insert 108, and check valve 400 replaces phasing check valve 62 and supply check valve 120. Valve spool 200, insert 300, and check valve 400 will be described in greater detail in the paragraphs that follow.

Valve spool 200 includes an outer peripheral surface 202 which is cylindrical and centered about camshaft axis 16 and which sized to interface with valve bore 64 of camshaft phaser attachment bolt 28 is a close sliding fit which allows valve spool 200 to move axially within valve bore 64 while substantially preventing oil from passing between the interface of outer peripheral surface 202 and valve bore 64. Valve spool 200 also includes a valve spool bore 204 which is centered about camshaft axis 16 and extends into valve spool 200 from a valve spool first end 206 which is proximal to camshaft 14 toward a valve spool second end 208 which is distal from camshaft 14.

Valve spool 200 includes pairs of passages which provide fluid communication from outer peripheral surface 202 to valve spool bore 204 as will now be described. A pair of spool supply passages 210 is provided for selectively communicating oil from bolt supply passages 74 to valve spool bore 204. Spool supply passages 210 each take the form of a sector of an annulus such that spool supply passages 210 are diametrically opposed to each other. A pair of spool advance passages 212 is provided for selectively providing fluid communication between bolt advance passages 92 and valve spool bore 204. Spool advance passages 212 each take the form of a sector of an annulus such that spool advance passages 212 are diametrically opposed to each other and spaced axially apart from spool supply passages 210 and axially separated from spool supply passages 210 by outer peripheral surface 202. A pair of spool recirculation passages 214 is provided for selectively providing fluid communication from bolt advance passages 92 or bolt retard passages 98 to valve spool bore 204. Spool recirculation passages 214 each take the form of a sector of an annulus such that spool recirculation passages 214 are diametrically opposed to each other and spaced axially apart from spool advance passages 212 and axially separated from spool advance passages 212 by outer peripheral surface 202 such that spool advance passages 212 are located axially between spool supply passages 210 and spool recirculation passages 214. A pair of spool retard passages 216 is provided for selectively providing fluid communication between bolt retard passages 98 and valve spool bore 204. Spool retard passages 216 each take the form of a sector of an annulus such that spool retard passages 216 are diametrically opposed to each other and spaced axially apart from spool recirculation passages 214 and axially separated from spool recirculation passages 214 by outer peripheral surface 202 such that spool recirculation passages 214 are located axially between spool advance passages 212 and spool retard passages 216. A pair of spool lock pin vent passage 218 is provided for selectively providing fluid communication with bolt lock pin passages 86 in order to vent oil from lock pin 26. Spool lock pin vent passages 218 each take the form of a sector of an annulus such that spool lock pin vent passages 218 are diametrically opposed to each other and spaced axially apart from spool retard passages 216 and axially separated from spool retard passages 216 by outer peripheral surface 202 such that spool retard passages 216 are located axially between spool recirculation passages 214 and spool lock pin vent passages 218. However, it should be noted that spool lock pin vent passages 218 are rotated 90° about camshaft axis 16 compared to spool supply passages 210, spool advance passages 212, spool recirculation passages 214, and spool retard passages 216. A pair of spool lock pin supply passage 220 is provided for selectively providing fluid communication between bolt lock pin passages 86 and valve spool bore 204 in order to supply oil to lock pin 26. Spool lock pin supply passages 220 each take the form of a sector of an annulus such that spool lock pin supply passages 220 are diametrically opposed to each other and spaced axially apart from spool lock pin vent passages 218 and axially separated from spool lock pin vent passages 218 by outer peripheral surface 202 such that spool lock pin vent passages 218 are located axially between spool retard passages 216 and spool lock pin supply passages 220. However, it should be noted that spool lock pin supply passages 220 are rotated 90° about camshaft axis 16 compared to spool lock pin vent passage 218. A pair of spool vent passages 222 extend radially outward from valve spool bore 204 in order to allow oil from spool lock pin vent passages 218 to be vented to valve bore 64, as will be described in greater detail later, and out of camshaft phaser 12 where it may be drained back to oil source 76.

Valve spool bore 204 includes a valve spool bore first portion 204*a* which is proximal to valve spool second end 208 and which is sealingly engaged with insert 300 as will be described in greater detail later. A valve spool bore second portion 204*b* extends axially away from valve spool bore first portion 204*a* and is slightly larger in diameter than valve spool bore first portion 204*a*, thereby defining a valve spool bore transition 204*c* which joins valve spool bore first portion 204*a* and valve spool bore second portion 204*b* where valve spool bore transition 204*c* may be a radius as shown, or may alternatively be a straight shoulder. Valve spool bore second portion 204*b* extends toward valve spool first end 206 such that each of spool supply passages 210, spool advance passages 212, spool recirculation passages 214, spool retard passages 216, spool lock pin vent passage 218, and spool lock pin supply passage 220 each enter valve spool bore 204 at valve spool bore second portion 204*b*. A valve spool bore third portion 204*d* extends axially away from valve spool bore second portion 204*b* to valve spool first end 206 and is slightly larger in diameter than valve spool bore second portion 204*b*, thereby defining a valve spool bore shoulder 204*e* which joins valve spool bore second portion 204*b* and valve spool bore third portion 204*d*. Valve spool bore shoulder 204*e* is preferably perpendicular to camshaft axis 16 and is in sealing engagement with insert 300. A valve spool bore retention groove 204*f* extends radially outward from valve spool bore third portion 204*d* and receives a wave spring 224 which is compressed axially between valve spool bore retention groove 204*f* and insert 300, thereby urging insert 300 into sealing engagement with valve spool bore shoulder 204*e* as will be described in greater detail later.

Insert 300 extends from an insert first end 302 which is proximal to valve spool first end 206 to an insert second end 304 which is proximal to valve spool second end 208. An insert first end wall 306 is located at insert first end 302 and is sized to fit within valve spool bore third portion 204*d* such that an axial face 306*a* of insert first end wall 306 is in sealing contact with valve spool bore shoulder 204*e*, thereby substantially preventing oil from passing between the interface of axial face 306*a* and valve spool bore shoulder 204*e*. Insert first end wall 306 may include an insert clocking feature 306*b* which interfaces with a complementary valve spool clocking feature 226 in order to properly orient insert 300 about camshaft axis 16 within valve spool 200 and prevent rotation of insert 300 within valve spool 200 about camshaft axis 16. As illustrated herein, insert clocking feature 306*b* may be a protrusion and valve spool clocking feature 226 may be a notch at valve spool first end 206.

An insert second end wall 308 is located at insert second end 304 and is sized to fit within valve spool bore first portion 204*a* and valve spool bore second portion 204*b*. Insert second end wall 308 includes an annular groove 308*a* which extends radially inward from the outer periphery of insert second end wall 308. Insert second end wall 308 is sized such that when the portion of insert second end wall 308 which is proximal to insert second end 304 is inserted into valve spool bore first portion 204*a* in a direction from valve spool first end 206 toward valve spool second end 208, the direction being illustrated by arrow 309 in FIG. 16, the outer periphery of insert second end wall 308 is sheared off. The material of the outer periphery of insert second end wall 308 that is sheared off is deposited in an annular chamber 310 that is formed radially between annular groove 308*a* and valve spool bore 204 where the portion of insert second end wall 308 that is sheared off by insertion is illustrated by reference number 311 in FIG. 16. By allowing this material of insert second end wall 308 to be sheared off, sealing engagement radially between insert second end wall 308 and valve spool bore 204 is ensured by eliminating the potential for manufacturing variations to produce a gap, i.e. minimum material conditions, which would allow leakage. After the material has been sheared off of insert second end wall 308, the portion of insert second end wall 308 which is located within valve spool bore first portion 204*a* is in sealing engagement therewith, and the portion of insert second end wall 308 which is located within valve spool bore second portion 204*b* is larger in diameter than the portion of insert second end wall 308 which is located within valve spool bore first portion 204*a*. It should be noted that the portion of insert second end wall 308 that is to be sheared off is illustrated in phantom lines to show its initial condition.

An insert central portion 312 extends between, and joins, insert first end wall 306 and insert second end wall 308. An insert bore 314, which is centered about camshaft axis 16, extends through insert central portion 312 from insert first end 302 to insert second end 304, thereby providing fluid communication from insert first end 302 to insert second end 304.

Insert 300 includes an insert first ledge 316, an insert second ledge 318, an insert third ledge 320, and an insert fourth ledge 322 which extend outward from insert central portion 312. Insert first ledge 316 and insert second ledge 318 are laterally spaced apart from each other while insert third ledge 320 and insert fourth ledge 322 are laterally spaced apart from each other, and furthermore, insert first ledge 316 and insert third ledge 320 are spaced axially apart from each other while insert second ledge 318 and insert fourth ledge 322 are spaced axially apart from each other. An insert first wall 324 is laterally adjacent to insert first ledge 316 and extends in a direction radially outward from camshaft axis 16 further than insert first ledge 316. Similarly, an insert second wall 326 is laterally adjacent to insert second ledge 318 and extends in a direction radially outward from camshaft axis 16 further than insert second ledge 318. Consequently, a first insert groove 328 is formed between insert first wall 324 and insert second wall 326. An insert third wall 330 is laterally adjacent to insert third ledge 320 and extends in a direction radially outward from camshaft axis 16 further than insert third ledge 320. Similarly, an insert fourth wall 332 is laterally adjacent to insert fourth ledge 322 and extends in a direction radially outward from camshaft axis 16 further than insert fourth ledge 322. Consequently, a second insert groove 334 is formed between insert third wall 330 and insert fourth wall 332.

Insert 300 also includes an insert first vent tower 336 and an insert second vent tower 338 which each extend radially outward from insert central portion 312 such that insert first vent tower 336 and insert second vent tower 338 are diametrically opposed to each other and sealingly engage valve spool 200 around spool lock pin vent passages 218. An insert vent passage 340 extends through insert first vent tower 336 and insert second vent tower 338 such that such that insert vent passage 340 is in constant fluid communication with spool lock pin vent passages 218 and such that insert vent passage 340 intersects with insert bore 314. In this way, oil vented from lock pin 26 is provided with a path to spool vent passages 222 via spool lock pin vent passages 218, insert vent passage 340, and insert bore 314. As should now be clear, insert 300 defines a phasing volume 342 which is axially between insert first end wall 306 and insert second end wall 308 and which is radially between insert central portion 312 and valve spool bore 204. Insert 300 also defines a venting volume 344, i.e. insert bore 314 and insert vent passage 340, which is fluidly segregated from phasing volume 342.

Insert 300 also includes insert supply check valve limiters 346 which extend outward from insert central portion 312 and which are aligned with spool supply passages 210 and also includes insert phasing check valve limiters 348 which extend outward from insert central portion 312 and which are aligned with spool recirculation passages 214. Insert supply check valve limiters 346 are diametrically opposed to each other, and similarly, insert phasing check valve limiters 348 are diametrically opposed to each other. In addition to insert phasing check valve limiters 348, insert 300 includes insert phasing check valve pivot members 350 which extend outward from insert central portion 312 and which are located axially between insert phasing check valve limiters 348 and insert second end wall 308. Insert phasing check valve pivot members 350 are diametrically opposed to each other. The function of insert supply check valve limiters 346, insert phasing check valve limiters 348, and insert phasing check valve pivot members 350 will be described in greater detail later.

Insert 300 is preferably made in a plastic injection molding process which net forms all of the previously described features in a single molding operation where insert 300 may be made of a glass-reinforced nylon material.

Check valve 400 is made of a single piece of sheet metal which is stamped and formed to include the features which will now be described. Check valve 400 is carried by insert 300 and includes a check valve spine 402 which rests on insert first ledge 316, insert second ledge 318, insert third ledge 320, and insert fourth ledge 322. Check valve spine 402 is located between, and constrained laterally by, insert first wall 324 and insert second wall 326. Check valve spine 402 may also be located between, and constrained laterally by, insert third wall 330 and insert fourth wall 332.

Check valve 400 includes supply check valve members 404 which are aligned with spool supply passages 210 such that supply check valve members 404 move between a seated position and an unseated position such that supply check valve members 404 engage valve spool 200 in the seated position which prevents oil from flowing out of valve spool bore 204 through spool supply passages 210 and such that supply check valve members 404 separate from valve spool 200 in the unseated position which permits oil to flow into valve spool bore 204 through spool supply passages 210. It should be noted that movement of supply check valve members 404 is dictated by pressure differentials between spool supply passages 210 and phasing volume 342. Supply check valve members 404 are diametrically opposed to each other and are retained by, and biased into the seated position by, respective supply check valve arms 406 which extend from check valve spine 402. Supply check valve arms 406 are resilient and compliant, thereby flexing in order to allow supply check valve members 404 to move between the seated and unseated positions. Supply check valve arms 406 first extend from check valve spine 402 laterally, then extend axially, thereby providing a gap laterally between a portion of supply check valve arms 406 and check valve spine 402. Movement of supply check valve members 404 in the unseated position is limited by insert supply check valve limiters 346.

Check valve 400 also includes check valve positioning members 408 which extend laterally from check valve spine 402. Check valve positioning members 408 are located between insert first wall 324 and insert third wall 330 and also between insert second wall 326 and insert fourth wall 332 such that check valve positioning members 408 are constrained thereby in a direction which is parallel to camshaft axis 16. Check valve positioning members 408 are resilient and compliant such that check valve positioning members 408 are held in compression against the inner periphery of valve spool bore 204 where compression of check valve positioning members 408 hold check valve 400 in contact with insert 300, thereby minimizing movement of check valve 400.

Check valve 400 includes phasing check valve members 410 which are aligned with spool recirculation passages 214 such that phasing check valve members 410 move between a seated position and an unseated position such that phasing check valve members 410 engage valve spool 200 in the seated position which prevents oil from flowing out of valve spool bore 204 through spool recirculation passages 214 and such that phasing check valve members 410 separate from valve spool 200 in the unseated position which permits oil to flow into valve spool bore 204 through spool recirculation passages 214. It should be noted that movement of phasing check valve members 410 is dictated by pressure differentials between spool recirculation passages 214 and phasing volume 342. Phasing check valve members 410 are diametrically opposed to each other and are retained by, and biased into the seated position by respective phasing check valve arms 412 which extend from check valve spine 402. Phasing check valve arms 412 are resilient and compliant, thereby flexing in order to allow phasing check valve members 410 to move between the seated and unseated positions. Phasing check valve arms 412 first extend from check valve spine 402 laterally, then extend axially, thereby providing a gap laterally between a portion of phasing check valve arms 412 and check valve spine 402. Movement of phasing check valve members 410 in the unseated position is limited by insert phasing check valve limiters 348 and phasing check valve arms 412 engage and pivot about insert phasing check valve pivot members 350 during movement between the seated position and the unseated position.

Valve spool 200, insert 300, and check valve 400 as described herein allows for simplified construction of camshaft phaser 12 compared to the prior art and ensures that check valve 400 is supported by insert 300 while minimizing sliding contact between check valve 400 and insert 300, thereby minimizing wear. Additionally, inclusion of annular chamber 310 allows for a portion of insert second end wall 308 to be sheared off which ensures sealing in the radial direction between insert second end wall 308 and valve spool 200.

While valve spool 200, insert 300, and check valve 400 have been illustrated herein as being applied to a cam torque actuated camshaft phaser, it should be understood that some features may be equally applicable to camshaft phasers which utilize pressurized oil from an oil source to change phase relationship.

While this invention has been described in terms of preferred embodiments thereof, it is not intended to be so limited, but rather only to the extent set forth in the claims that follow.

We claim:

1. A camshaft phaser for use with an internal combustion engine for controllably varying a phase relationship between a crankshaft and a camshaft in said internal combustion engine, said camshaft phaser comprising:

an input member connected to said crankshaft of said internal combustion engine so as to provide a fixed ratio of rotation between said input member and said crankshaft;

an output member connected to said camshaft of said internal combustion engine and defining an advance chamber and a retard chamber with said input member;

a valve spool which moves along an axis between an advance position and a retard position and having a valve spool bore extending into said valve spool along said axis, wherein said advance position allows oil to be vented from said advance chamber and to be supplied to said retard chamber from said valve spool bore so as to advance timing of said camshaft relative to said crankshaft and wherein said retard position allows oil to be vented from said retard chamber and to be supplied to said advance chamber from said valve spool bore so as to retard the timing of said camshaft relative to said crankshaft;

an insert within said valve spool bore; and a check valve carried by said insert within said valve spool bore, said check valve including a check valve member which moves between a seated position and an unseated position such that said check valve member prevents fluid flow out of said valve spool bore through a passage and such that said check valve member permits the fluid flow into said valve spool bore through said passage, respectively, and said check valve also including a check valve positioning member which is held in compression against an inner periphery of said valve spool bore such that compression of said check valve positioning member holds said check valve in contact with said insert when said check valve member is in said seated position and also when said check valve member is in said unseated position.

2. A camshaft phaser as in claim 1, wherein:

said check valve further includes a check valve spine from which said check valve member and said check valve positioning member extend; and said insert includes an insert groove within which said check valve spine is located.

3. A camshaft phaser as in claim 2, wherein said insert groove is laterally bounded by a first insert wall and a second insert wall such that said first insert wall and said second insert wall constrain lateral movement of said check valve spine.

4. A camshaft phaser as in claim 3, wherein said insert further includes a third insert wall such that said check valve positioning member is constrained by said first insert wall and said third insert wall in a direction which is parallel to said axis.

5. A camshaft phaser as in claim 1, wherein:

said passage is a first phasing passage through said valve spool and said valve spool further includes a second phasing passage through said valve spool;

said check valve member is a first phasing check valve member and said check valve further includes a second phasing check valve member;

said first phasing check valve member selectively engages said valve spool which prevents the fluid flow out of said valve spool bore through said first phasing passage;

said first phasing check valve member selectively separates from said valve spool which permits the fluid flow into said valve spool bore through said first phasing passage;

said second phasing check valve member selectively engages said valve spool which prevents the fluid flow out of said valve spool bore through said second phasing passage; and said second phasing check valve member selectively separates from said valve spool which permits the fluid flow into said valve spool bore through said second phasing passage.

6. A camshaft phaser as in claim 5, wherein said check valve further includes a check valve spine from which said first phasing check valve member and said second phasing check valve member extend in opposing lateral directions.

7. A camshaft phaser as in claim 6, wherein:

said check valve positioning member is a first check valve positioning member;

said check valve further includes a second check valve positioning member;

said first check valve positioning member and said second check valve positioning member are each held in compression against said inner periphery of said valve spool bore such that compression of said first check valve positioning member and said second check valve positioning member holds said check valve in contact with said insert when said first phasing check valve member and said second phasing check valve member are engaged with said valve spool and also when said first phasing check valve member and said second phasing check valve member are separated from said valve spool.

8. A camshaft phaser as in claim 7, wherein said first check valve positioning member and said second check valve positioning member extend from said check valve spine in opposing lateral directions.

9. A camshaft phaser as in claim 8, wherein said insert includes an insert groove within which said check valve spine is located.

10. A camshaft phaser as in claim 9, wherein said insert groove is laterally bounded by a first insert wall and a second insert wall such that said first insert wall and said second insert wall constrain lateral movement of said check valve spine.

11. A camshaft phaser as in claim 10, wherein said insert further includes a third insert wall and a fourth insert wall such that said first check valve positioning member is constrained by said first insert wall and said third insert wall in a direction which is parallel to said axis and such that said second check valve positioning member is constrained by said first insert wall and said fourth insert wall in said direction which is parallel to said axis.

12. A camshaft phaser as in claim 1, wherein:

said insert includes an insert end wall which includes an annular groove extending radially around an outer periphery of said insert end wall;

said outer periphery sealingly engages said valve spool bore; and an annular chamber is formed radially between said annular groove and said valve spool bore which captures debris caused by insertion of said insert end wall into said valve spool bore.

13. A camshaft phaser as in claim 12, wherein:

said valve spool bore includes a valve spool bore first portion;

said valve spool bore further includes a valve spool bore second portion which is larger in diameter than said valve spool bore first portion; and said annular chamber is formed radially between said annular groove and said valve spool bore first portion and also radially between said annular groove and said valve spool bore second portion.

14. A camshaft phaser as in claim 13, wherein:

a portion of said insert end wall is in sealing engagement with said valve spool bore first portion;

a portion of said insert end wall which is within said valve spool bore second portion is larger in diameter than said portion of said insert end wall which is within said valve spool bore first portion.

15. A camshaft phaser for use with an internal combustion engine for controllably varying a phase relationship between a crankshaft and a camshaft in said internal combustion engine, said camshaft phaser comprising, wherein:

an input member connected to said crankshaft of said internal combustion engine so as to provide a fixed ratio of rotation between said input member and said crankshaft;

an output member connected to said camshaft of said internal combustion engine and defining an advance chamber and a retard chamber with said input member;

a valve spool which moves along an axis between an advance position and a retard position and having a valve spool bore extending into said valve spool along said axis, wherein said advance position allows oil to be vented from said advance chamber and to be supplied to said retard chamber from said valve spool bore so as to advance timing of said camshaft relative to said crankshaft and wherein said retard position allows oil to be vented from said retard chamber and to be supplied to said advance chamber from said valve spool bore so as to retard the timing of said camshaft relative to said crankshaft;

an insert within said valve spool bore; and a check valve carried by said insert within said valve spool bore, said check valve including a check valve member which moves between a seated position and an unseated position such that said check valve member prevents fluid flow out of said valve spool bore through a passage and such that said check valve member permits the fluid flow into said valve spool bore through said passage, respectively; wherein:

said insert includes an insert end wall which includes an annular groove extending radially around an outer periphery of said insert end wall;

said outer periphery sealingly engages said valve spool bore;

an annular chamber is formed radially between said annular groove and said valve spool bore which captures debris caused by insertion of said insert end wall into said valve spool bore;

said valve spool bore includes a valve spool bore first portion;

said valve spool bore further includes a valve spool bore second portion which is larger in diameter than said valve spool bore first portion; and said annular chamber is formed radially between said annular groove and said valve spool bore first portion and also radially between said annular groove and said valve spool bore second portion.

16. A camshaft phaser as in claim 15, wherein:

a portion of said insert end wall is in sealing engagement with said valve spool bore first portion;

a portion of said insert end wall which is within said valve spool bore second portion is larger in diameter than said portion of said insert end wall which is within said valve spool bore first portion.

* * * * *